US007775936B2

(12) United States Patent
Wilkinson

(10) Patent No.: US 7,775,936 B2
(45) Date of Patent: Aug. 17, 2010

(54) TOTAL BODY EXERCISE MACHINE

(76) Inventor: William T. Wilkinson, 29 Sunset Dr., P.O. Box 73, Salem, NJ (US) 08079

( * ) Notice: Subject to any disclaimer, the term of this patent is extended or adjusted under 35 U.S.C. 154(b) by 1172 days.

(21) Appl. No.: 11/039,323

(22) Filed: Jan. 20, 2005

(65) Prior Publication Data

US 2005/0124471 A1 Jun. 9, 2005

Related U.S. Application Data

(63) Continuation-in-part of application No. 10/611,763, filed on Jul. 1, 2003, now abandoned, which is a continuation-in-part of application No. 10/033,108, filed on Dec. 28, 2001, now abandoned.

(60) Provisional application No. 60/463,534, filed on Apr. 17, 2003, provisional application No. 60/259,293, filed on Dec. 29, 2000.

(51) Int. Cl.
*A63B 71/00* (2006.01)

(52) U.S. Cl. ..... 482/8; 482/51; 482/54; 482/70

(58) Field of Classification Search ..... 482/1–9, 482/51, 54, 57, 63, 70, 900–902; 434/247
See application file for complete search history.

(56) References Cited

U.S. PATENT DOCUMENTS

| | | | |
|---|---|---|---|
| 518,967 | A | 5/1894 | Poole |
| 605,237 | A | 6/1898 | Spink |
| 775,989 | A | 11/1904 | Roberts |
| 1,016,729 | A | 2/1912 | Barrett |
| 1,870,244 | A | 8/1932 | Elston |
| 2,017,128 | A | 10/1935 | O'Neill, Jr. |
| 3,544,105 | A | 12/1970 | Latta |
| 3,596,907 | A | 8/1971 | Brighton et al. |
| 3,610,617 | A | 10/1971 | Hepburn |
| 3,640,530 | A | 2/1972 | Henson et al. |
| 3,642,279 | A | 2/1972 | Cutter |
| 3,643,943 | A | 2/1972 | Erwin, Jr. et al. |
| 3,690,654 | A | 9/1972 | Hepburn |
| 3,731,917 | A | 5/1973 | Townsend |
| 3,764,132 | A | 10/1973 | Hepburn |

(Continued)

OTHER PUBLICATIONS

U.S. Appl. No. 10/848,398, filed May 18, 2004, Wilkinson.

(Continued)

*Primary Examiner*—Glenn Richman
(74) *Attorney, Agent, or Firm*—RatnerPrestia

(57) ABSTRACT

An exercise apparatus comprising a lower body exercise machine, at least one upper body exercise module positioned for engagement by a user of the machine, each module adapted to provide resistance to the user's full natural arm swing. Each module comprises an elongated connector, a user engagement connected to one end of the elongated connector for engaging or being engaged by a body appendage of a user, and a resistance mechanism for resisting a tensile force applied to the end of the elongated connector. The apparatus comprises a mechanism for adjusting the incline of the user platform of the lower body exercise machine and/or a mechanism for adjusting an attached railing between a close position suitable for gripping by the user and a far position sufficiently distant from the close position to prevent interference with the full natural arm swing of the user.

50 Claims, 10 Drawing Sheets

U.S. PATENT DOCUMENTS 3,826,491 A 7/1974 Elder
3,833,216 A 9/1974 Philbin
3,861,215 A 1/1975 Bradley
3,874,659 A 4/1975 Aharoni
3,929,331 A 12/1975 Beeding
4,114,874 A 9/1978 Mattila
4,114,875 A 9/1978 Deluty
4,138,106 A 2/1979 Bradley
4,235,439 A 11/1980 De Donno
4,344,616 A 8/1982 Ogden
4,373,716 A 2/1983 Pagani
4,538,804 A 9/1985 Zibell
4,557,480 A 12/1985 Dudley
4,625,962 A 12/1986 Street
4,659,077 A 4/1987 Stropkay
4,705,269 A 11/1987 DeBoer et al.
4,779,866 A 10/1988 Marshall et al.
4,779,867 A 10/1988 Hinds
4,798,377 A 1/1989 White
4,838,543 A 6/1989 Armstrong et al.
4,844,449 A 7/1989 Truslaske
4,884,802 A 12/1989 Graham
4,886,266 A 12/1989 Trulaske
4,921,247 A 5/1990 Sterling
5,013,035 A 5/1991 Nathaniel
5,085,426 A 2/1992 Wanzer et al.
5,112,287 A 5/1992 Brewer
5,147,264 A 9/1992 Braathen
5,176,599 A 1/1993 Beliakov
5,178,591 A 1/1993 Lyons
5,207,622 A 5/1993 Wilkinson et al.
5,226,867 A 7/1993 Beal
5,230,676 A 7/1993 Terauds
5,254,064 A 10/1993 Rock
5,318,491 A 6/1994 Houston
5,352,167 A 10/1994 Ulicny
5,378,212 A 1/1995 Pin-Kuo
5,405,305 A 4/1995 Wilkinson et al.
5,409,435 A * 4/1995 Daniels ..... 482/5
5,429,572 A 7/1995 Brown et al.
5,460,586 A 10/1995 Wilkinson et al.
5,476,431 A 12/1995 Wilkinson et al.
5,486,149 A 1/1996 Smith et al.
5,607,375 A 3/1997 Dalebout et al.
5,618,249 A 4/1997 Marshall
5,632,708 A 5/1997 Wilkinson et al.
5,669,857 A 9/1997 Watterson et al.
5,733,231 A 3/1998 Corn et al.
5,803,874 A 9/1998 Wilkinson
5,876,310 A 3/1999 Mackey et al.
5,951,449 A 9/1999 Oppriecht
6,042,516 A 3/2000 Norton
6,123,649 A 9/2000 Lee et al.
6,149,559 A 11/2000 Mackey
6,261,209 B1 7/2001 Coody
6,302,829 B1 * 10/2001 Schmidt ..... 482/70
6,387,015 B1 5/2002 Watson
6,436,008 B1 8/2002 Skowronski et al.
D467,632 S 12/2002 Berns
2002/0086779 A1 7/2002 Wilkinson

OTHER PUBLICATIONS

DP® Fit for Life General Price List, Jun. 1, 1993 (2 pages); DP® Fit for Life Treadmills Brochure (3 pages); DP® Fit for Life Roadmaster 1995 Catalog (4 pages); Detailed sketch by Randy Bartlett, Jul. 2002 (1 page).
Justin Leonard, "Cable Flex by Jackie Chan," Fitness Informercial Review; May 5, 2003; 4 pages. http://www.fitnessinfomercialreview.com/cableflex.htm.
EXERCISave.com, Jackie Chan's CableFlex Gym; Apr. 17, 2003; 2 pages.
International Search Report dated Jul. 31, 2002, to application No. PCT/US01/50649 (corresponding PCT application).
Kevin P. Moran; Protest Under 37CFR 1.291(a); "Resistance Devices, Total-Body Exercise Machines Outfitted Therewith, and Exercise Methods Using Such Devices and Machines"; filed Jul. 21, 2004; 10 pp.
Kevin P. Moran; Protest Under 37 CFR 1.29(a); Exercise Device for Exercising Upper Body Simultaneously With Lower Body Exercise; filed Jul. 21, 2004; 8 pp.
NordicTrack Fitness At Home Catalog, Winter 1996; 44 pp.
International Search Report dated Nov. 16, 2004, to PCT/US04/11735.
Advertisement for Skytec, Fitness Quest Inc. website, 3 pages, Dec. 7, 2001.
Advertisement for Nordic Track Classic Pro, Nordic Track website, 2 pages., Dec. 31, 2001.
PowerBelt information, Body Trends website, 7 pages, Feb. 1999.
Advertisement for Star Trac V-bike® Spinner®, Indoor Group Cycling Superstore website, 6 pages, Jun. 30, 2003.
Advertisement for NordicTrack Incline Trainer; 1p., Jan. 3, 2005.
Advertisement for CFS Treadmill; 2 pp., Mar. 19, 2004.
CFS RT 1 Core Fitness System Owner's Guide; 35 pp, Mar. 19, 2004.

* cited by examiner

TOTAL BODY EXERCISE MACHINE

CROSS-REFERENCE TO RELATED APPLICATIONS

This application is a continuation-in-part of U.S. patent application Ser. No. 10/611,763, filed Jul. 1, 2003, now abandoned which is a continuation-in-part of U.S. patent application Ser. No. 10/033,108, filed Dec. 28, 2001, now abandoned and which claims priority from U.S. Provisional Patent Application Ser. No. 60/463,534, filed on Apr. 17, 2003. Patent application Ser. No. 10/033,108 further claims priority from U.S. Provisional Patent Application Ser. No. 60/259,293, filed on Dec. 29, 2000. All of the above-named prior applications are hereby incorporated herein by reference.

TECHNICAL FIELD

This invention relates to exercise machines, and more particularly to lower body exercise machines, such as but not limited to treadmills, having an upper body exercise component for providing total-body exercise.

BACKGROUND OF THE INVENTION

The exercise and fitness industry continues to be an area of high growth, marked by a proliferation of exercise machines. Among many of the most popular exercise machines are aerobic leg exercise machines, such as but not limited to: treadmills, air walkers/gliders, upright and recumbent bicycle machines, torso-twisting disks, cross-trainers, steppers, elliptical exercise machines, cross-country and downhill ski machines, trampolines, squat machines, rowing machines, stretching machines, riders, and the like.

Many exercise machines have some sort of handrail, grip, or handlebars for resting the arms, while other embodiments provide nothing to hold on to, and still other embodiments have some type of mechanism to enable simultaneous exercising of the arms and/or upper body. Such mechanisms may include but are not limited to poles, shafts, or arms that, for example, move back and forth. Machines with such mechanisms for exercising both the legs or lower body and arms or upper body are often referred to as "dual action" or "total body" exercise machines.

Dual action or total body machines have a number of benefits, including offering a more complete total body exercise that includes both the arms and/or the upper as well as the lower body. The increased work raises the user's metabolism and heart rates more quickly than single action machines, and maintains the higher metabolism and heart rate throughout the workout. Such machines are therefore more efficient, providing more exercise in less time. The arm exercise features also strengthen, tone, or shape the arm muscles during the aerobic workout. The overall safety of machines with such features is also typically enhanced, as the arm exercise mechanisms typically provide improved balance to the user as compared to embodiments without such mechanisms.

The co-pending Ser. Nos. 10/611,763 and 10/033,108 applications noted above and incorporated herein by reference, both of which include William T. Wilkinson as the inventor or co-inventor/assignee, (hereinafter referred to as "the parent applications") disclose a number of total body exercise machines that provide for upper body exercise with a full, natural forward and/or backward arm swing simultaneously with lower body exercise. Treadmill embodiments are featured extensively in the parent applications, although the inventions discussed therein are not limited to treadmill embodiments.

Many types of treadmills are well known in the art, including automated treadmills in which a motor moves the tread under the user's feet, to set a pace at which the user may run or walk. Other treadmills, referred to as "manual" treadmills, do not provide such a motor, but rather rely upon the forces generated by the user to move the tread.

Many treadmills are known in the art to include an elevation mechanism to provide an optional incline of the treadmill to simulate walking up hill, and to therefore increase the intensity of the workout. Examples of automated treadmills having an automated elevation mechanism, which allows a user to increase or decrease the incline through the use of a motorized mechanism, may be found in the following issued U.S. patents, incorporated herein by reference: U.S. Pat. No. 3,643,943 to Erwin, Jr. et al.; U.S. Pat. No. 3,826,491 to Elder; U.S. Pat. Nos. 4,844,499 and 4,886,266 to Truslaske; U.S. Pat. No. 5,085,426 to Wanzer et al.; U.S. Pat. No. 5,352,167 to Ulicny; U.S. Pat. No. 5,378,212 to Pin-Kuo; U.S. Pat. No. 5,669,857 to Watterson et al; and U.S. Pat. No. 6,436,008 to Skowronski et al. The following U.S. patents describe manual mechanisms for adjusting the incline of a treadmill, all of which are also incorporated by reference: U.S. Pat. No. 3,731,917 to Townsend; U.S. Pat. No. 4,344,616 to Ogden; and U.S. Pat. No. 5,607,375 to Dalebout et al. U.S. Pat. No. 1,870,244 to Elston, also incorporated herein by reference, although not specific to treadmills, also describes an automated lifting jack mechanism suitable for use on a treadmill.

Treadmill embodiments with side railings are well known in the art. Because of the full, natural arm swing anticipated with the treadmill designs disclosed in the parent applications, it is disclosed that treadmill embodiments with side railings may provide those railings spaced radially from the treadmill frame far enough, and/or have a height low enough, and/or only extending from the front to the back of the machine only far enough to avoid interfering with the natural arm swing of the universal user. There may be times, however, such as when a user decides not to use the upper body exercise devices on a total body machine, when the user would prefer to have the rails in the more standard position.

Although the parent applications describe a number of different resistance devices that may be used to provide the resistance, and do not limit certain aspects of the inventions disclosed therein to any particular types of resistance devices, certain types of resistance devices may be desired for particular purposes in particular situations.

Thus, in the continuous search for an optimum total body exercise device, particular combinations of elements may be surprisingly effective and desirable to potential users.

SUMMARY OF THE INVENTION

One aspect of the invention comprises an exercise apparatus for exercising the upper body simultaneously with lower body exercise, the apparatus comprising a lower body exercise machine and at least one upper body exercise module positioned for engagement by a user of the lower body exercise device. The lower body exercise machine has a user platform positioned relative to a surface on which the machine is positioned, the machine comprising a mechanism for adjusting an incline of the platform relative to the surface. Each upper body exercise module is adapted to provide resistance to a full natural arm swing of at least one arm of the user, and comprises an elongated connector having first and second ends; a user engagement connected to the elongated connector first end for engaging or being engaged by a body appendage of a user; and a resistance mechanism for resisting a tensile force applied to the first end of the elongated connector. The apparatus may further comprise an adjustable railing along at least one side of the lower body exercise machine, the adjustable railing having at least a close position suitable for gripping by the user while using the machine, and a far position sufficiently distant from the close position to prevent interference with the full natural arm swing of the user during use of the upper body exercise device simultaneously with the lower body exercise machine.

Another aspect of the invention comprises an exercise apparatus for exercising the upper body simultaneously with lower body exercise, the apparatus comprising a lower body exercise machine, at least one upper body exercise module attached to the lower body exercise machine, and an adjustable railing attached to the lower body exercise machine. Each upper body exercise module is adapted to provide resistance to a full natural arm swing of at least one arm of the user, and comprises an elongated connector having first and second ends; a user engagement connected to the elongated connector first end for engaging or being engaged by a body appendage of a user; and a resistance mechanism for resisting a tensile force applied to the first end of the elongated connector. The adjustable railing has at least a first position suitable for gripping by the user while using the lower body exercise machine, and a second position sufficiently distant from the first position to prevent interference with the full natural arm swing of the user during use of the upper body exercise device simultaneously with the lower body exercise machine.

One embodiment of the invention comprises an apparatus comprising a manual treadmill having a user platform positioned relative to a surface on which the treadmill is positioned, a mechanism for adjusting (automatically or manually) an incline of the platform relative to the surface, at least one upper body exercise module positioned for engagement by a user of the treadmill, and an adjustable railing along at least one side of the treadmill. Each upper body exercise module is adapted to provide resistance to a full natural arm swing of at least one arm of the user and comprises an elongated connector having first and second ends, a user engagement connected to the elongated connector first end for engaging or being engaged by a body appendage of a user, and a resistance mechanism for resisting a tensile force applied to the first end of the elongated connector. The adjustable railing has at least a close position suitable for gripping by the user while using the treadmill, and an open position sufficiently distant from the close position to prevent interference with the full natural arm swing of the user during use of the upper body exercise device simultaneously with the treadmill. The apparatus preferably comprises a first upper body exercise module for one arm and a second upper body exercise module for the other arm. The treadmill may comprise means for positioning the upper body resistance modules to provide resistance to a forward arm swing of the user or a backward arm swing of the user. The upper body resistance modules may further be adapted to be positioned for use for performing exercises using the upper body resistance module by a user not standing on the user platform and not simultaneously exercising the lower body using the lower body exercise machine. Docking interfaces may be provided for resting the user engagements in close proximity to the user when the upper body resistance modules are not in use.

Yet another aspect of the invention comprises an arm exercise device comprising an elongated connector having a first end with a connecting member for attaching to a hasp and a second end attached to a resistance mechanism for resisting a tensile force applied to the first end of the elongated connector, and a user engagement attached to the connecting member, the user engagement comprising a glove or mitt to be worn by the user and comprising the hasp for receiving the connecting member.

Still another aspect of the invention comprises an exercise apparatus for exercising the upper body simultaneously with lower body exercise, the apparatus comprising a lower body exercise machine other than a cross-country ski machine, and a single upper body exercise module attached in a forward position on the lower body exercise machine to provide resistance to a backward arm swing of each arm of the user. The upper body exercise module comprises a pair of user engagements attached to an elongated connector wound at least partially around a reel, the reel comprising means for resisting revolution of the reel in response to a pulling force transmitted by the user onto the elongated connector.

DETAILED DESCRIPTION OF INVENTION

The invention will next be illustrated with reference to the figures. The figures are intended to be illustrative rather than limiting and are included herewith to facilitate the explanation of this invention.

Inclined Exercise Bed

Figure 1:
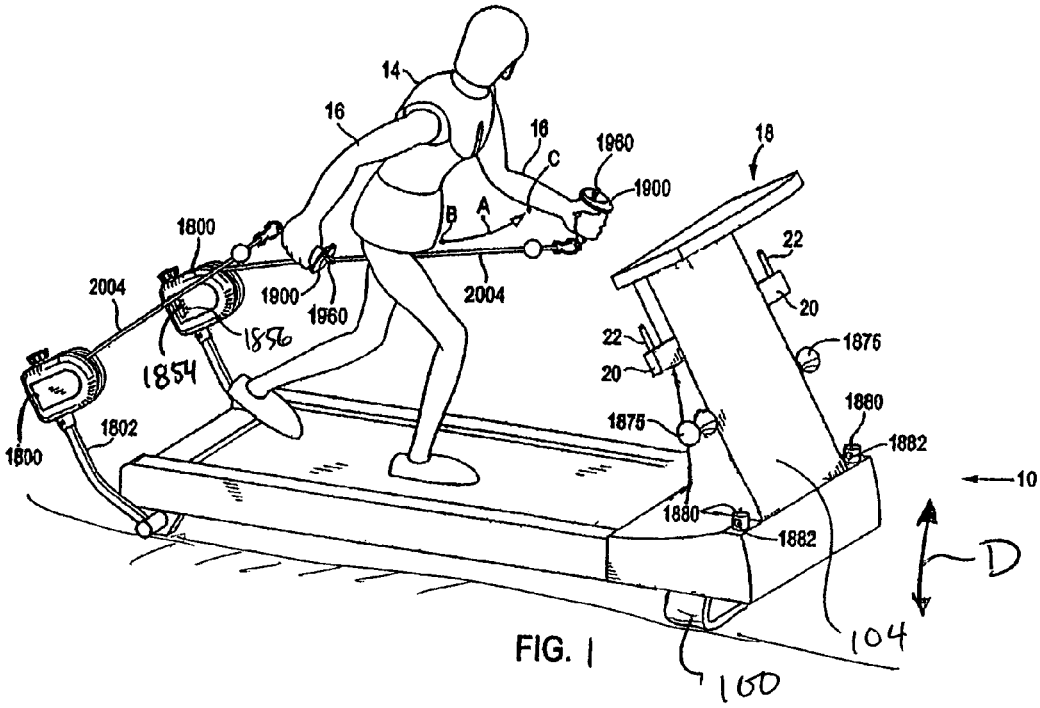
FIG. 1 is a perspective view illustration of a user on an exemplary treadmill outfitted with exemplary upper body exercise modules, with the treadmill bed positioned essentially parallel to the ground.

Referring now to FIG. 1, there is shown a user 14 on an exercise machine 10, namely a treadmill. Machine 10 comprises two upper body exercise devices, namely resistance modules 1800 (shown in more detail in FIGS. 8 and 9), mounted behind user 14 to be used for exercising the user's arms. Modules 1800 are positioned on mounting arms 1802 to enable the natural, free-swinging back and forth motion of arms 16 of user 14. User 14 swings each arm 16 forward in an upward arc along arrow A, extending from below the waist or preferably behind the user's body at or to the rear of point B, and moving alongside to point C in front of the user's body. Most of the effort is exerted by pulling and lifting the arms on the upswing (in the direction of arrow A), while letting the arms swing backward freely on the downswing (opposite the direction of arrow A).

It should be noted although the figures in this application depict exemplary resistance modules 1800, any type of resistance module may be used, in particular any of the upper body exercise device embodiments shown or described in the parent applications. Although depicted with two resistance modules (one for each arm) in FIG. 1, the invention is not limited to dual module designs, and may particularly include single module embodiments for use by both arms, and embodiments having more than two modules, as shown and described in the parent applications.

Figure 2:
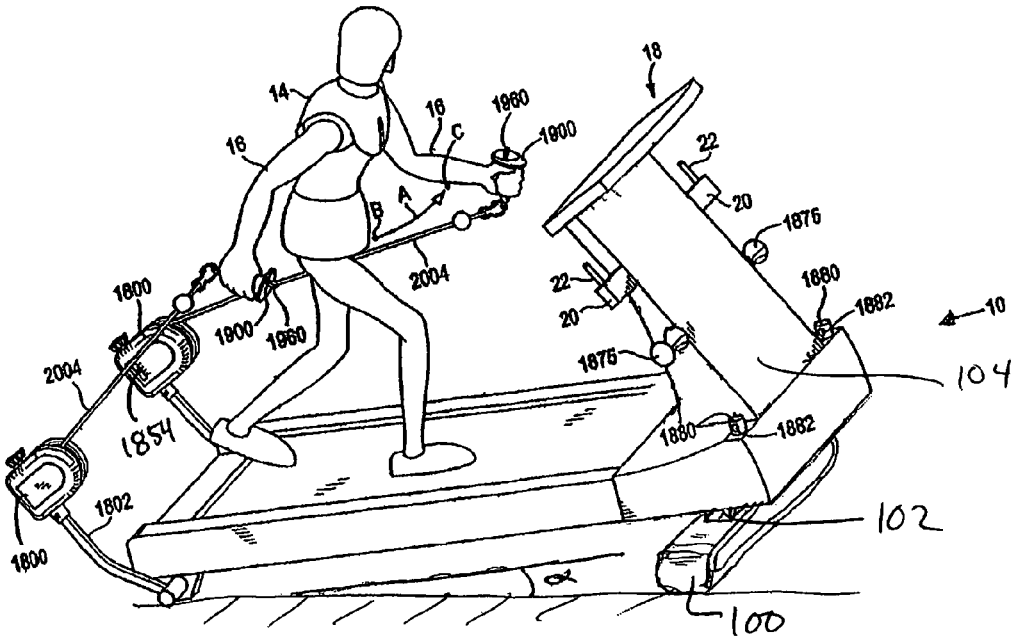
FIG. 2 is a perspective view illustration of a user on the treadmill of FIG. 1, with the treadmill bed positioned at an angle $\alpha$ relative to the ground.

FIG. 2 shows the same treadmill as in FIG. 1, except now the treadmill is inclined relative to the ground at an angle $\alpha$. As noted in the background section, a number of mechanisms are known in the art for manually or automatically raising or lowering the bed of a treadmill. Thus, treadmill 10 includes such a incline-adjustment mechanism. The invention is not limited to any particular mechanism, although an automated incline-adjustment mechanism is preferred. As shown in FIG. 2, front foot 100 of the treadmill is attached to a riser 102, the upper part of which is housed in front cabinet 104. Incline mechanism (not shown), optionally mounted partially inside cabinet 104, extends or retracts riser 102 relative to the treadmill bed such that the front end of the treadmill raises or lowers along arrow D. Suitable mechanisms may be found in any of the U.S. Patents listed in the background section, but the invention is not limited to any particular mechanism. Treadmill 10 is preferably a manual treadmill, but it may also be a motorized treadmill. The benefit of a manual treadmill is that the user is required to do more work, thereby increasing the workout. By automating the incline mechanism on a manual treadmill, the user can further increase the workout on the fly, without having to leave the normal use position of the treadmill just to adjust the incline, thereby disrupting the workout.

Figure 10:
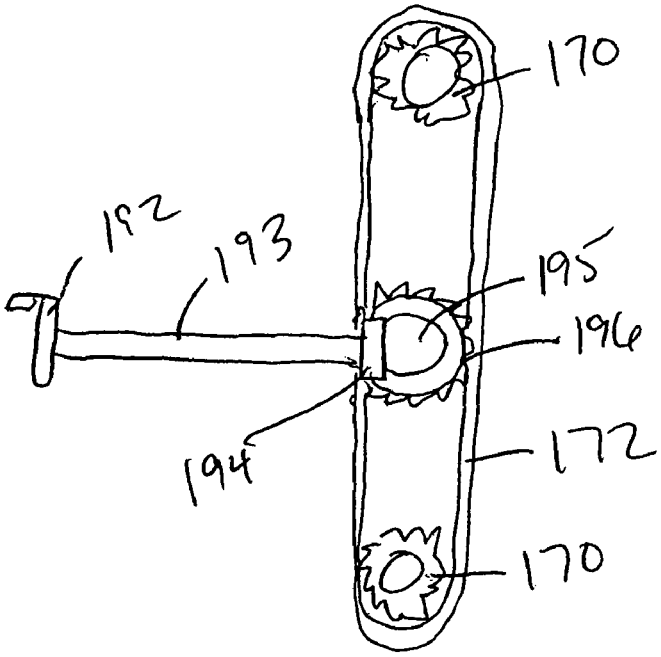
FIG. 10 depicts a plan view of an exemplary gear train for providing a manual incline adjustment mechanism operable by the user while in a normal use position on the lower body exercise machine.

Accordingly, to the extent that a manual lift mechanism may be used, a preferred mechanism allows the user to adjust the incline without leaving the normal use position of the treadmill. For example, the mechanism shown by Ogden in U.S. Pat. No. 4,344,616, may be modified through a simple gear train, as shown in FIG. 10, such that operating handle 192 is provided in a position forward of the user, such as on console 18 or extending through cabinet 104 and attached to a shaft 193 that extends to a drive gear 194 for driving another gear or pinion 195 fixed a sprocket 196 for driving the drive chain 172 that drives sprockets 170 attached to threaded members 120 and 122 (shown in Ogden).

Railings For Accommodating User Arm Swing

Figure 3:
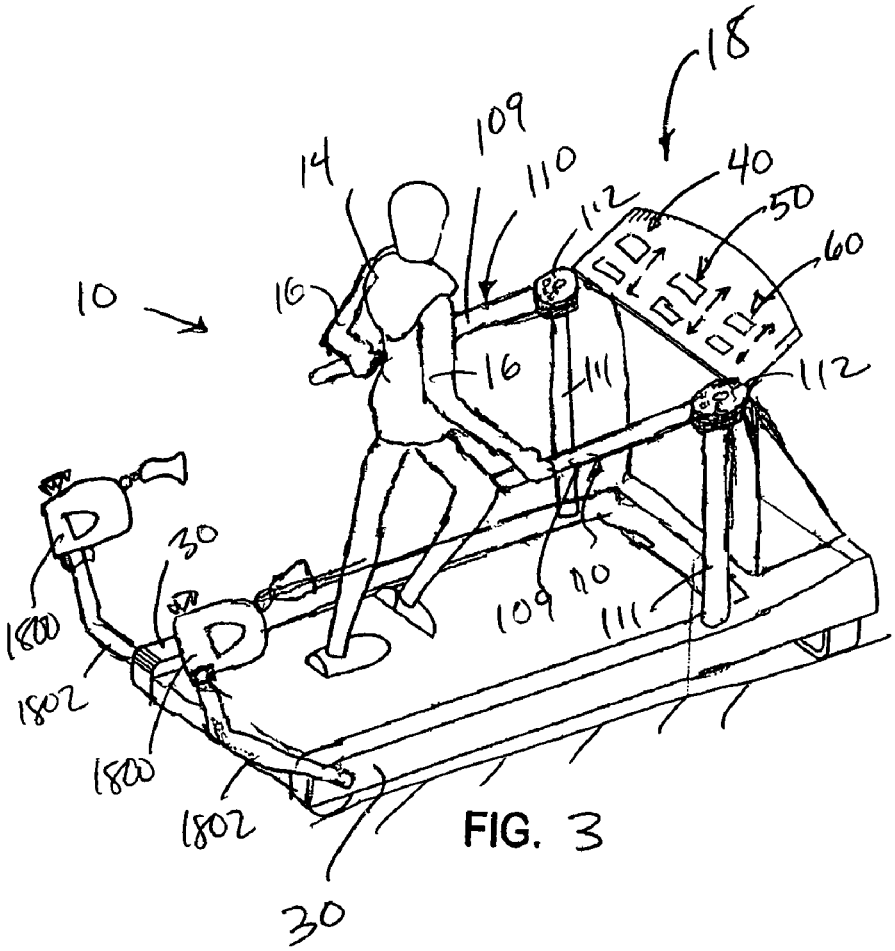
FIG. 3 is a perspective view illustration of a user on a treadmill similar to that of FIG. 1, but with a set of adjustable railings in a close position in which the user is gripping the railing rather than using the upper body exercise devices.
Figure 4:
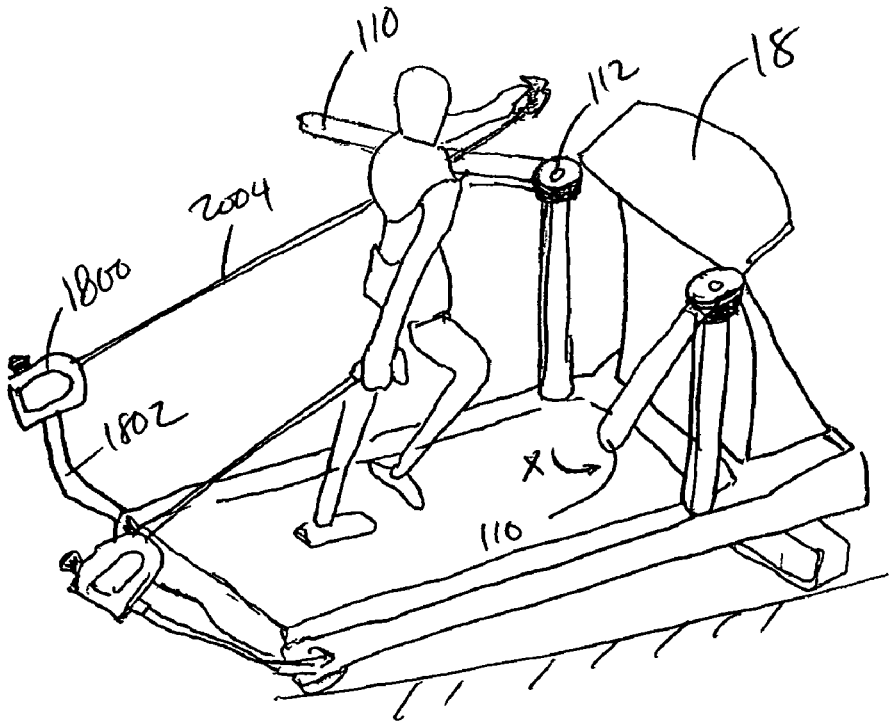
FIG. 4 is a perspective view illustration of a user on the treadmill of FIG. 3, but with the set of adjustable railings in a far position in which the user is exercising using both the lower body exercise machine and the upper body exercise devices.

FIGS. 3 and 4 depict a treadmill similar to that shown in FIG. 2, except that the treadmill now includes a pair of railings 110. As shown in FIG. 3, the railings are in a close position, in which the railings are essentially parallel to side edges 30 of the treadmill bed. In the close position, the railings allow the user 14 to rest his or her arms 16 while holding onto the railings and exercising only the lower body.

Figure 5A:
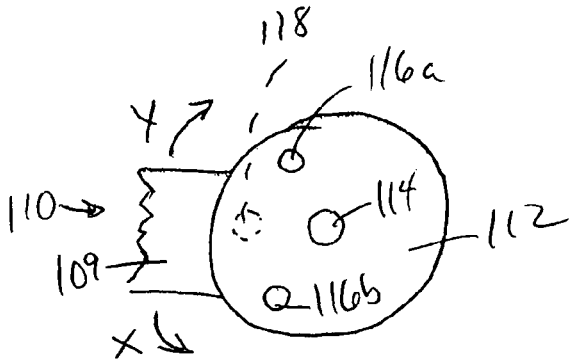
FIG. 5A is a top view illustration of a portion of an exemplary railing in-out pivot mechanism.
Figure 5B:
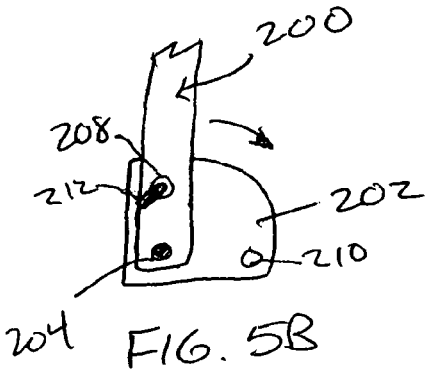
FIG. 5B is a side view illustration of a portion of an exemplary railing forward-backward pivot mechanism.
Figure 5C:
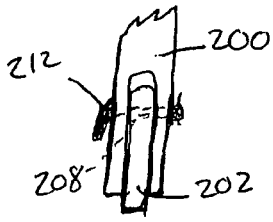
FIG. 5C is a front view of the mechanism shown in FIG. 5B.

Railings in a close position, however, may be in the way of the user 14 when swinging his or her arms 16 while exercising both the upper body and lower body. Accordingly, as shown in FIG. 4, railings 110 are adjustable by pivoting in the direction X into a far position as shown in FIG. 4. As shown in more detail in FIG. 5A, in one exemplary embodiment, railing 110 may comprise a pivot plate 112 that connects the horizontal portion 109 of railing 110 to the vertical portion 111. Pivot plate 112 may comprise, for example, a pivot pin 114 about which the plate pivots and a plurality of anchor holes 116*a* and 116*b* through which a biased prong 118, located underneath the pivot plate and fixed relative to the horizontal portion 109 of railing 110, protrudes when the hole and prong are aligned. Thus, if the pivot plate in FIG. 5A is a depiction of the pivot plate on the rightmost railing 110 shown in FIG. 3, when prong 118 protrudes through hole 116*a* the railing is anchored in the close position, and when prong 118 protrudes through hole 116*b*, the railing is anchored in the far position. If the pivot plate depicted in FIG. 5A is for the leftmost railing in FIG. 3, the relationship between the prong and holes for the far and close positions is reversed.

In other embodiments, the railing adjustment mechanism may be automated. For example, each railing may be attached to a shaft that is driven by an individual motor, or gearing or a drive chain attached to a single motor for both railings. Gear, motor, and drive systems are well known in the art and may be adapted by those skilled in the art to fit the geometry of any particular system. Controls for the motor may be mounted on console 18, similar to the way in which the incline and resistance controls are depicted in FIG. 3 and discussed herein later.

Although shown in FIGS. 3-5A with pivot mechanisms for moving the railings outward to the side relative to the user, other mechanisms may be provided for moving the railings forward or backward, or for raising or lowering the railings to move them out of the way of the user. For example, as shown in FIGS. 5B and 5C, the base of railing 200 may be held in place by a bracket 202 with a pivot point 204 and at least two holes 208 and 210 in the bracket for receiving a locking pin 212 that extends through the bracket and the railing base to fix the railing in the closed position (hole 208) and the open position (hole 210). Although depicted as a manual mechanism, a forward/backward tilt mechanism may also be automated, such as with a gear drive or any other mechanism known in the art.

Figure 5D:
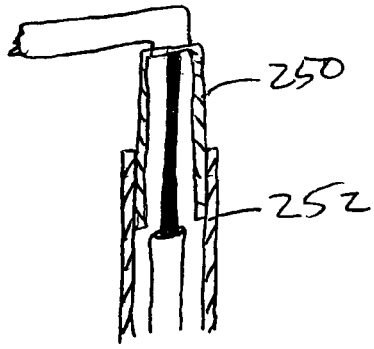
FIG. 5D is a partial cutaway view of a portion of a railing showing an exemplary mechanism for raising or lowering the railing.
Figure 5E:
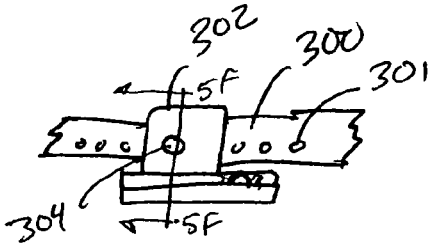
FIG. 5E is a partial cutaway side view of a portion of a railing showing an adjustment mechanism for forward/backward adjustment.
Figure 5F:
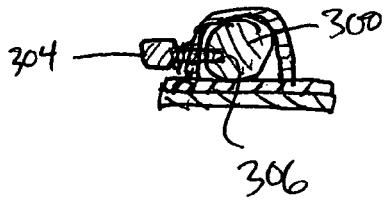
FIG. 5F is a cross-sectional view of the portion shown in FIG. 5E, through lines 5F-5F.

Another method of providing forward/backward adjustability is shown in FIGS. 5E and 5F, namely providing a rail 300 with a plurality of holes 301, a bracket 302 for conforming to the outer periphery of the rail to hold it steady, and a biased pin 304 that can be pulled out by the user to disengage the end 306 of pin 304 from inside of one of the holes 301, to allow the rail to be moved forward or backward and the end of the pin again extended into one of the holes. Such a forward/backward mechanism may be provided in conjunction with a pivot plate 112 as shown and described above, to allow the rail to be pivoted inward and outward also. This may allow a user with limited space either forward of the machine or to the sides of the machine to use one mechanism or the other to accommodate the space available.

It should be noted that any type of mechanism may be used for providing manual or automated adjustment of the rails. Furthermore, to the extent that manual pin-and-hole arrangements are described herein in the form of a locking pin, a biased prong, or a biased pin, with respect to various embodiments, such mechanisms should be understood to be interchangeable with one another. Thus, no aspect of the invention is limited to any particular type of pin-and-hole mechanism or any type of adjustment mechanism generally, whether manual or automated.

In yet another embodiment, depicted in FIG. 5D, the railing may comprise an inner sleeve 250 and an outer sleeve 252, within which is a hydraulic or pneumatic piston 254, a screw (not shown), or other mechanism for raising or lowering one sleeve relative to the other to thereby raise or lower the railing. Although a hydraulic/pneumatic mechanisms and screw mechanisms are well suited for automatic action, a manual pump (for the hydraulic or pneumatic mechanisms) or crank (such as for the screw mechanism) may also be used. A non-automated embodiment for raising or lowering railings may be provided by using a similar inner and outer sleeve design, but with the inner sleeve having a biased pin and the outer sleeve having a plurality of holes along its length into which the pin can protrude to fix the height.

In still other embodiments, as described in the parent applications, the railings may be non-adjustable, but spaced radially from the treadmill frame far enough, and/or have a height low enough, and/or extend from the front to the back of the machine only far enough so as to avoid interfering with the natural arm swing of the universal user. Fixed railings avoid the extra complexity of an adjustment mechanism and allow a user to use the railings for rest when desired, but have the disadvantage of not being a standard, most comfortable position for use. Adjustable railings can be located to be in a comfortable location for use when in the close configuration, and still have the advantage of being completely out of the way in the far position when not in use.

Although described with respect to an exemplary treadmill embodiment herein, the adjustable railings may be used on any type of lower body exercise device where railings are desired, and particularly lower body exercise machines which also include upper body exercise devices that enable a user to exercise with a full, natural arm swing, including but not limited to: treadmills, air walkers/gliders, upright and recumbent bicycle machines, torso-twisting disks, cross-trainers, steppers, elliptical exercise machines, cross-country and downhill ski machines, trampolines, squat machines, rowing machines, stretching machines, riders, and the like. For example, as shown with respect to bicycle embodiments in FIGS. 12 and 13, the term "railing" refers to the handlebars, and thus the term "railing" should be interpreted as used herein in the specification and claims to refer to any type of member that a user may hold for balance. Adjustable handlebars are shown for an upright bike in FIG. 12 and for a recumbent bike in FIG. 13. For a recumbent bike, the handlebars 350 are typically right near the user's seat 352. The arms for the handlebars may be mounted on a pivot disk 354 in which a biased pin 355 (similar to pin 304 shown in FIG. 5F) fixes the disk in a particular location through a hole in a mating disk. Pivot disks 354 are attached to the seat supports 356 such that the handlebars can be rotated out of the way of the user's swinging arms when resistance is used, as shown by the dashed lines.

Figure 11:
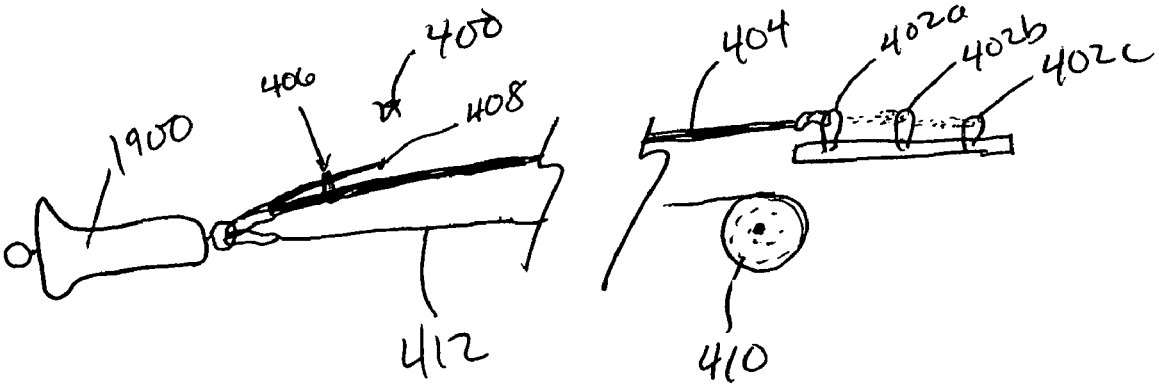
FIG. 11 depicts various methods of using elastic bands to provide adjustable resistance.
Figure 12:
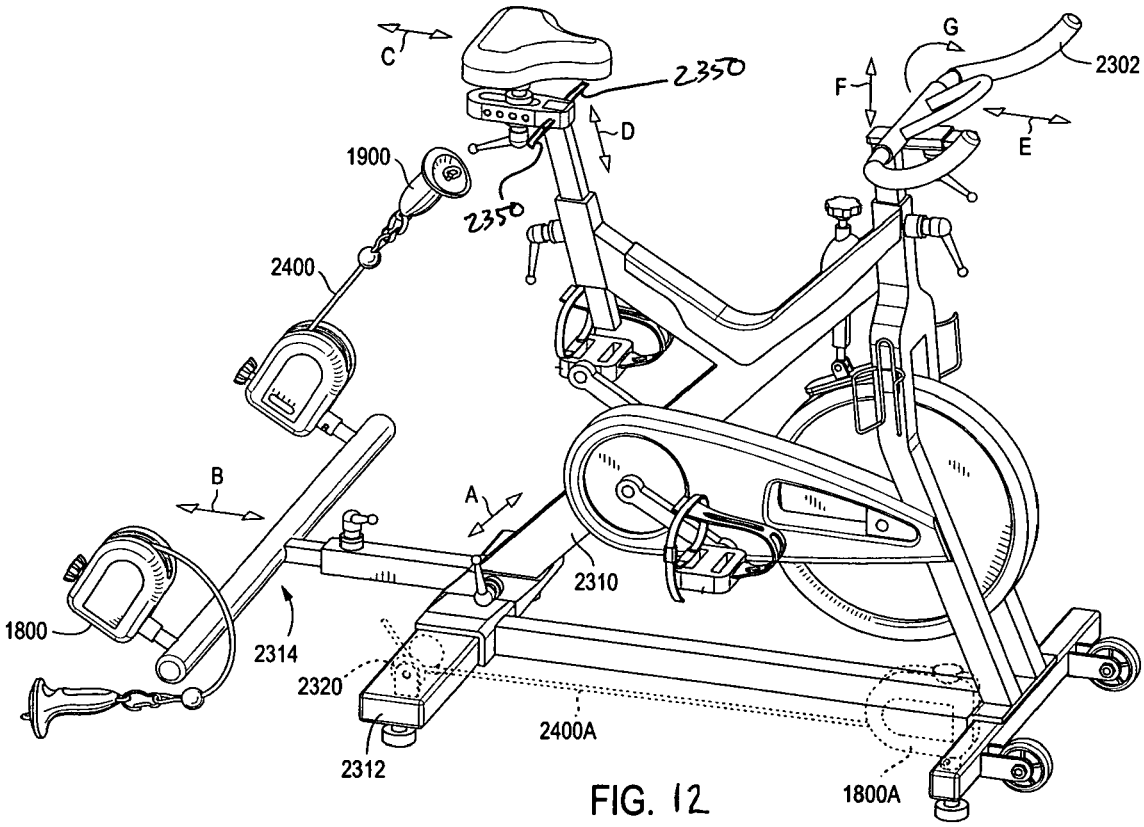
FIG. 12 is an illustration of an exemplary upright exercise bicycle embodiment of the present invention having adjustable handlebars.
Figure 13:
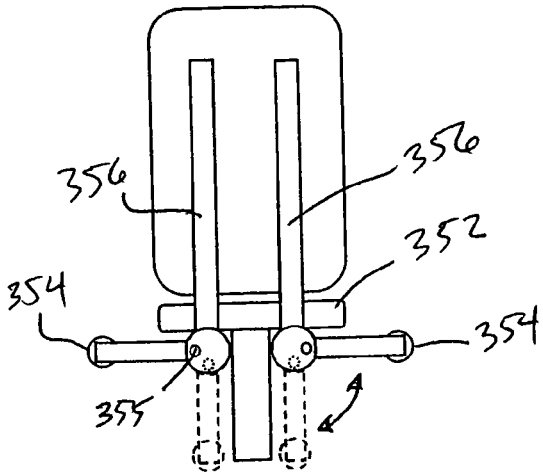
FIG. 13 is a rear view illustration of a portion of an exemplary recumbent bicycle seat showing adjustable handlebars.

For the upright bicycle design such as is shown in FIG. 12, the arm resistance devices are rear-mounted on mounting arm 2314 that is attached to shaft 2310 that extends to the foot 2312 of the bike. Mounting arms may be adjustable vertically, such as in one or more placement positions on shaft 2310 in the direction of arrow A, and/or horizontally, such as by having a variable extension distance from the shaft in the direction of arrow B. Referring now to the dashed lines in FIG. 11, the resistance modules 1800A may instead be mounted to the front of the machine, with a guide or pulley 2320 mounted to the rear of the machine to redirect connector 2400A to the user. To accommodate different sized users, the location of the bicycle seat may be adjustable frontward and backward on the machine along arrow C as well as vertically along arrow D as is known in the art. The handlebars may also be adjustable horizontally and vertically along arrows E and F, respectively, and may also be rotatable along arrow G. The handlebars are preferably adjustable into at least one position in which the handlebars are completely out of the way of the natural arm swing of the user. Pegs 2350 on which to rest the eyelets 1960 of handgrips 1900, or other means for resting the handgrips when not in use, may be provided in a location readily accessible by the user.

The adjustable railings allow the user to have a choice between gripping railings and maintaining a natural arm swing motion while exercising, with or without additional resistance as described herein, and in so doing provides a superior exercise workout. Resistance modules 1800 may be permanently attached to exercise machine 10 or may be detachable, and may be used to retrofit a pre-existing machine. Although mounting the devices behind the user for use in providing an arm workout is one preferred embodiment, the resistance devices of this invention may be placed anywhere on an exercise device in relation to the user, for use in working-out any portion of the user's body. Although any number of resistance units may be provided, a preferred embodiment comprises two resistance units, one for each arm and/or leg. Although four units may be provided so that both legs and both arms may be exercised simultaneously, another embodiment may comprise two units that may be adjustable for use with either arms or legs.

The resistance units may be permanently affixed to the machine, or may be detachable and removable. The resistance units may also be fixed in a particular place on the machine, but are preferably adjustable in one or more dimensions. The parent applications provide a number of embodiments illustrating this principle.

The resistance units may allow for adjustment in the amount of resistance, but units that are not adjustable may also be used. The adjustable resistance may be continuously adjustable within a certain range, may comprise incremental, stepped, non-continuous adjustment, or a combination thereof. The resistance may be adjustable, for example, using a dial or knob, such as knob 2019 shown in FIG. 8, and the resistance level may be visually indicated using a gauge, such as a pin 1854 that moves in association with the chosen resistance level relative to markings 1856 on the device cover (shown in FIG. 1).

Exemplary Upper Body Resistance Modules

Dual Reel Embodiments

Figure 8:
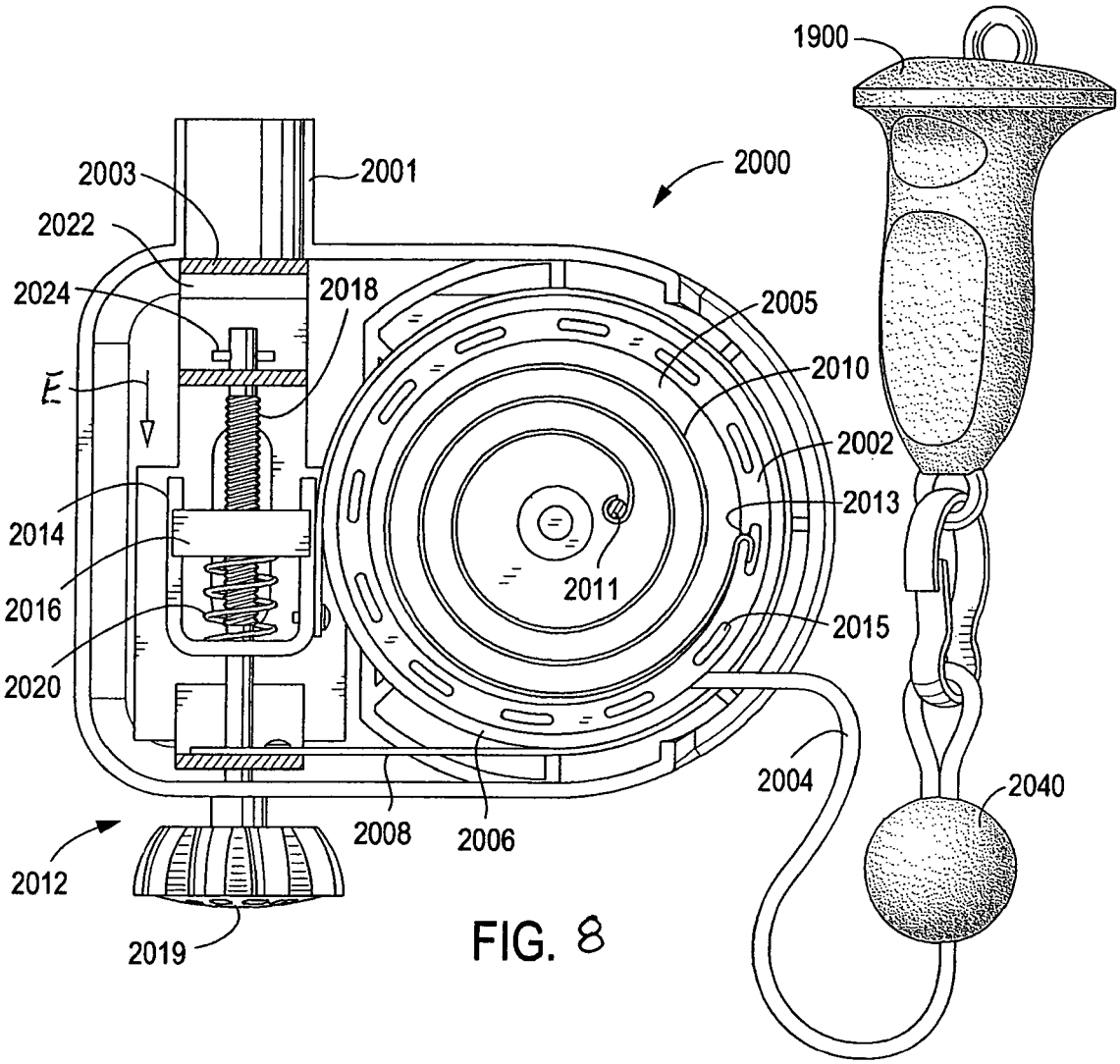
FIG. 8 is a plan view illustration of an exemplary exercise device with a top mounting piece removed.
Figure 9:
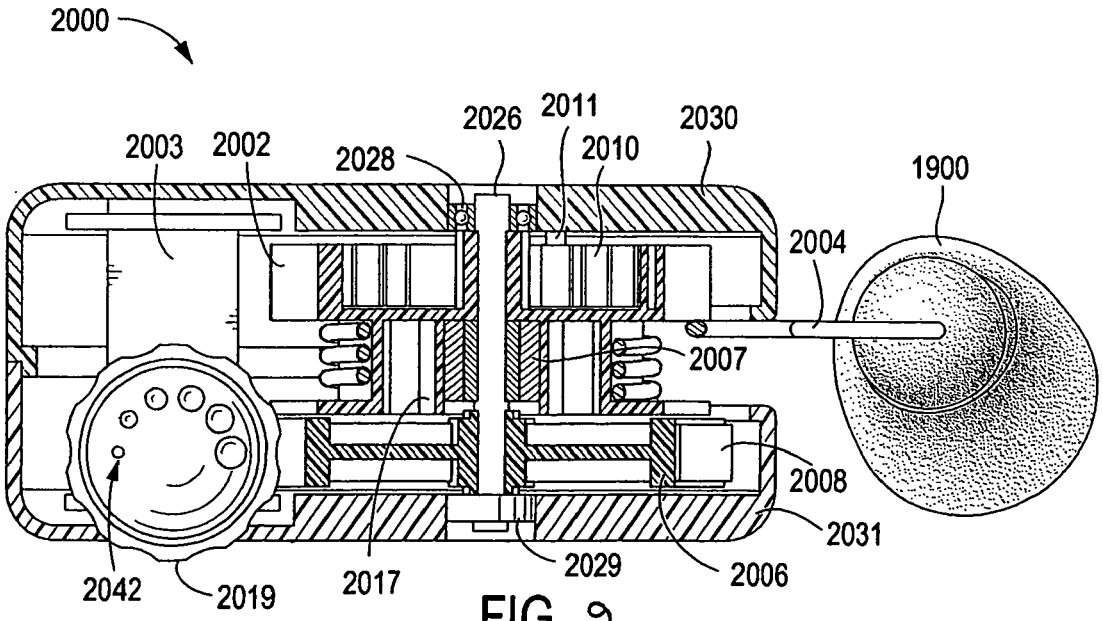
FIG. 9 is a top view, partial-cut-away illustration of the exemplary exercise device of FIG. 8.

Referring now to FIGS. 8 and 9, exemplary resistance module 1800 is shown in more detail. The invention is not limited to this particular resistance module, however. Module 1800 comprises a spool 2002 on which cable 2004 is wound and braking cylinder 2006 over which band brake 2008 is wrapped to provide resistance. A clutch mechanism 2007, such as a sprag clutch (also known in the art as a "needle-bearing clutch" or "needle-roller clutch bearing" as listed in the MCMASTER-CARR® online catalog, viewable at www-.mcmaster.com), is mounted on shaft 2026 between the shaft and spool 2002 so that the shaft 2026 (and thus braking cylinder 2006) only turns when cable 2004 is being unwound from the spool. Spiral torsion spring 2010 powers the retraction mechanism. As shown in FIG. 8, spring 2010 is mounted in a pocket 2005 formed by spool 2002, and fixed at one end to a pin 2011 attached to casing 2030 with the opposite end inserted in a slit 2013 that communicates with a channel 2015 in the outer wall of the pocket. A plurality of channels 2015 may be provided in the spool to reduce the weight of the spool. Any method of attaching the spiral torsion spring to an element that rotates with the spool at one end and to a fixed element at the other end, however, may be used.

Adjustable resistance is provided by tightening and loosening band brake 2008 using dial mechanism 2012. Dial mechanism comprises U-bracket 2014 attached to band brake 2008, traveler 2016 mounted on threaded shaft 2018, and helical spring 2020 mounted between the U-bracket and the traveler 2016. Threaded shaft 2018 rotates freely within mounting bracket 2022 and is kept from pulling out axially by end pin 2024. As shaft 2018 is rotated in a clockwise direction using dial 2019, traveler 2016 moves downward in the direction of arrow E, thereby also pushing U-bracket 2014 down in the direction of arrow E. This tightens band brake 2008 around braking cylinder 2006, creating a greater frictional resistance to turning the braking cylinder as cable 2004 is unwound from spool 2002. Spool 2002 and braking cylinder 2006 are mounted coaxially on a shaft 2026 which rotates within bearings 2028 and 2029 on first and second casing members 2030 and 2031, respectively. First casing member 2030 has been removed in FIG. 8 to expose the contents between the casing members. As shown in FIGS. 8 and 9, casing members 2030 and 2031 together comprise a two-piece contoured cover, preferably molded plastic to make the system lightweight, although the casing members may be any materials of construction and may have any type of geometry. In one embodiment, the casing members may comprise flat metal mounting plates, wherein a lightweight protective and/or decorative cover (not shown) may be provided over the mounting plates.

Clutch mechanism 2007 and bearings 2028 and 2029 are shown only schematically in FIG. 9, and thus it should be understood that module 1800 may comprise any types of clutches or bearings that are known in the art in any configuration. Although not visible in FIG. 8, a pin 1854 such as shown in FIG. 1 may be attached to traveler 2016 and protrude through the mounting plate and casing 2031 to enable a user to quickly gauge the resistance level by viewing the pin relative to markings 1856 on the casing.

Mounting stub 2001, such as for mounting directly on an exercise machine via a mounting post 1880 or for mounting at the end of an extension arm 1802 as shown in FIG. 1, is provided between casing members 2030 and 2031. Particularly where casing members 2030 and 2031 may be made of lightweight plastic, mounting stub 2001 may be metal and attached to a metal frame 2003 to provide a strong attachment point.

Ball stop 2040 may be provided at the end of cable 2004 to prevent the cable from being rewound too far into the spool. Knob 2019 may be provided with visual indicia 2042 that indicates which direction to turn the knob to increase or decrease resistance.

Although shown in FIGS. 8 and 9 as a spring, the retraction mechanism on the upper body exercise device may be of any type known in the art, however, such as but not limited to a spring, weight, or elastic member. The retraction mechanism may be adjustable to provide a range of retraction forces or may be non-adjustable. Preferably, the cable retraction mechanism has sufficient strength to allow for a full backswing without line slack, which is some embodiments, for example, has been found to require a cable retraction mechanism exerting at least 0.5 pounds of force.

The element providing the resistance may be anything known in the art, however, such as but not limited to a spring; an elastic member, including a tension band or ring; a weight, including weights that are lifted by pulling a cable wound about a pulley; a friction brake, including a brake on a reel or on the cable itself; a pressure pad; a screw; a device using magnetic, hydraulic, or pneumatic resistance; a bendable shape memory material such as a composite (i.e. a BOWFLEX® rod); or the like. The resistance mechanism may be adjustable or non-adjustable. The parent applications disclose other reel and resistance embodiments, any of which are applicable to the present invention, but the descriptions of which are not repeated here, having already been incorporated by reference.

As in the parent applications, the connecting member may comprise any type of non-rigid connection member, such as a cable, line, cord, tubing, band, strip, rope, chain, string, or other means known in the art suitable for transmitting tensile resistance to the arm movement of the user from spool. Such a connector allows a full and free range of motion (motion in multiple planes) of the user's arm or other body part engaged by the user engagement. Even a rigid elongated connector may be used, however, such as a pole provided as at least a portion of the connector, but that still allows a full and free range of motion, as disclosed and described in the parent applications.

Connector 2004 may be non-elastic or may have some elasticity. Cable 2004 is preferably just long enough to stretch from the mounting location of the reel to the furthest point of the user engagement from the mounting location during a standard arm swing.

Single Reel Embodiments

Figure 15A:
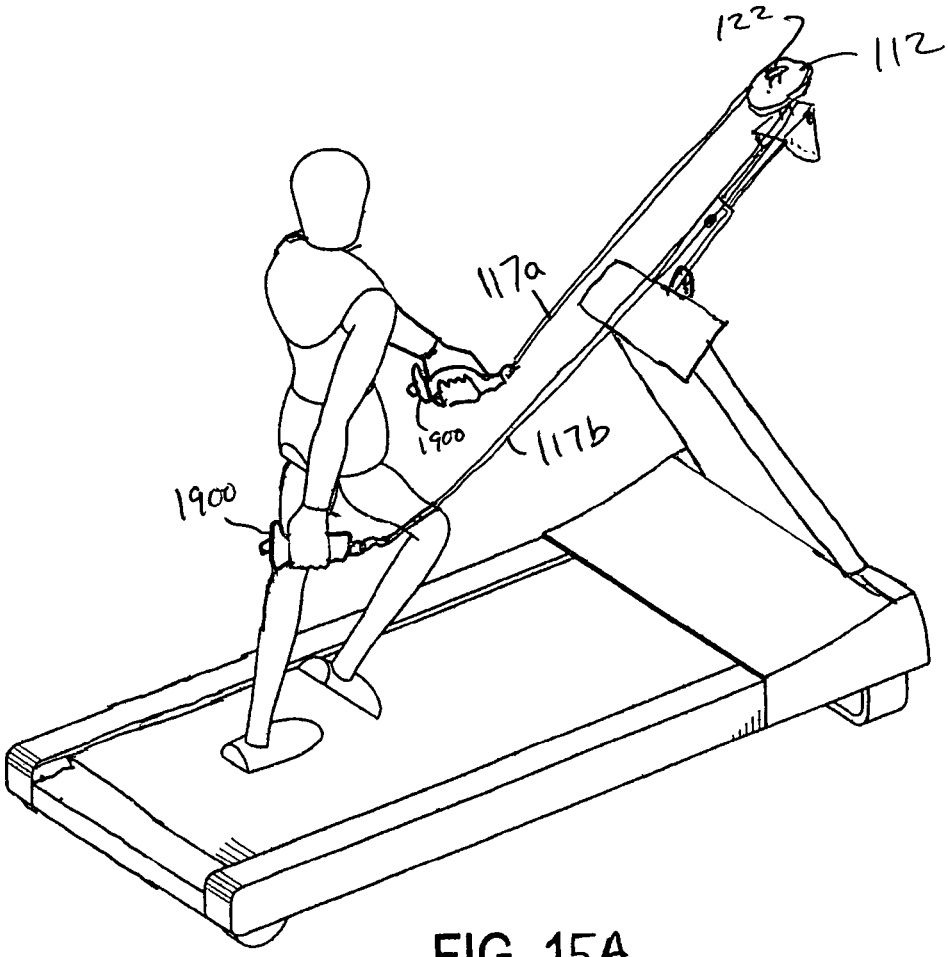
FIG. 15A is an illustration of an exemplary exercise machine comprising a front-mounted, single reel arm exercise embodiment.
Figure 15B:
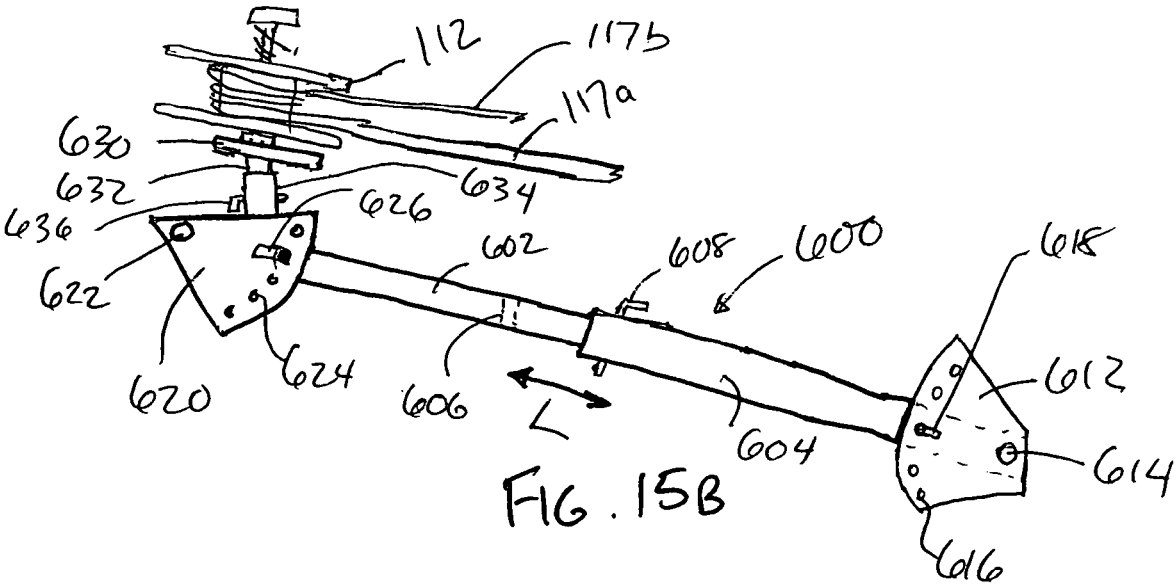
FIG. 15B is a side view illustration of an exemplary mounting arm for the single reel arm exercise device shown in FIG. 15A.
Figure 16A:
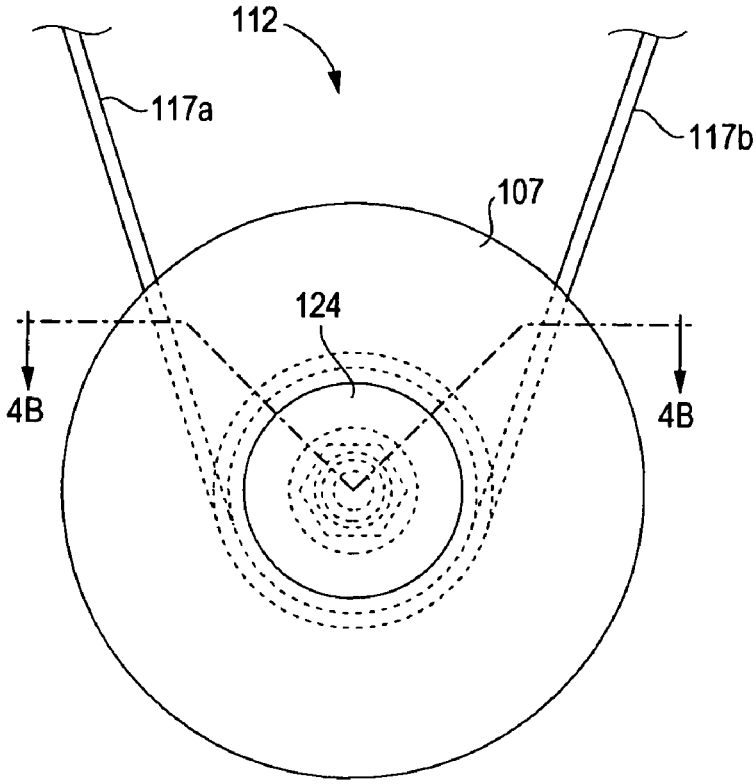
FIG. 16A is a plan view illustration of an exemplary single reel embodiment.

Although shown in FIGS. 1-4 with two reels 1800 with independent cables 2004 coming from each reel 1800, referring now to FIGS. 15A and 15B, a single reel 112 may be shared by both arms. Reel 112, as shown in greater detail in FIGS. 16A and 16B, may comprise one cable 117*a* for one arm and another cable 117*b* for the other arm, each cable wound on spool 107 in a different direction. Cables 117*a* and 117*b* may be two distinct cables or may comprise a common cable with its middle section wound around spool 107. Reel 112 as shown in FIG. 16B may be mounted on a mounting arm that is adjustable to accommodate users of different sizes while assuring that the tension forces on the cable are essentially perpendicular to the axis of the spool.

Figure 16B:
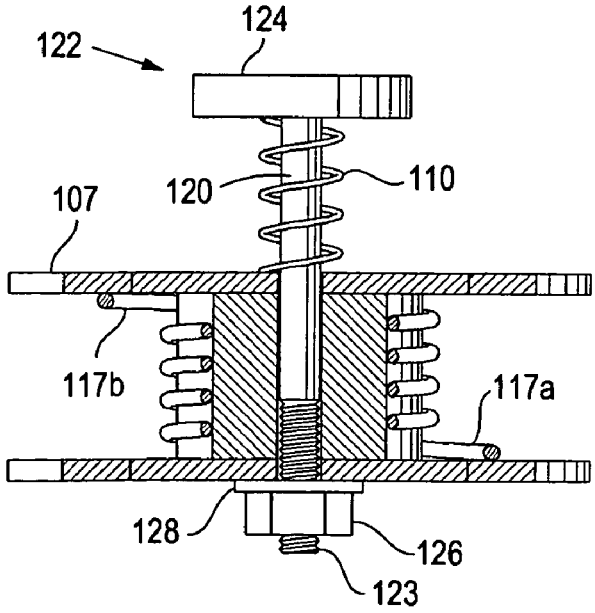
FIG. 16B is a partial cross-section side view illustration of an exemplary resistance mechanism on the single reel embodiment shown in FIG. 15A.

As shown in FIG. 16B, resistance may be provided in the single reel embodiment by a spring 110 mounted around shaft 120 of knob screw 122. As knob screw 122 is screwed downward to advance threads 123 into nut 126, which abuts one end of spool 107 via washer 128, knob 124 compresses spring 110 so that the pressure exerted by the spring on spool 107 increases. FIG. 16B shows only one exemplary mechanism for providing resistance, however, and other mechanisms may be used as are known in the art without limitation. The advantages of a single reel embodiment include the simplicity of design and the economic benefit of having only a single reel and cable. Single reel embodiments may limit the motion of one arm to the opposite motion of the other arm, however, which in some circumstances may not be desirable. Furthermore, single reel embodiments can provide only the same resistance for each arm, and the cable is not fully retractable when not in use.

Referring back to FIG. 15A, a single reel embodiment may be used in conjunction with a lower body exercise machine for providing resistance on the backswing or foreswing of the user, as is amply described in the parent applications. The single reel embodiment 112 shown in FIGS. 15A and 15B is mounted on a mounting arm 600 that provides flexibility in a number of directions. For example, the mounting arm comprises an inner sleeve 602 and an outer sleeve 604. Inner sleeve 602 has a number of channels 606 (representative channel shown in dashed lines) adapted to receive pin 608 which fits through mating a mating hole in outer sleeve 604. This allows length adjustment along arrow L. Machine bracket 612 affixes the mounting arm to the lower body exercise machine. Bracket 612 comprises a pivot pin 614 and a plurality of locking holes 616 through which a pin 618 can be placed to fix the mounting arm at a desired angle relative to the machine. Reel mounting bracket 620 comprises a pivot pin 622 and a plurality of locking holes 624 through which a pin 626 can be placed to fix the reel at a desired angle relative to the rest of the mounting arm. Reel 112 is mounted in on an plate 630 and pole 632 combination that fits within mounting sleeve 634. The mounting post 634 has one or more holes adapted to receive a pin 636 to fix the orientation of the pole in the sleeve. This allows the pole to be rotated at least 180 degrees to allow the cables 117*a* and 117*b* to face away from the machine so that a user may use the arm exercise device without standing on the lower body exercise machine. Thus, this allows a user to make use of the arm exercise device either simultaneously with lower body exercise, or alone as part of a separate exercise routine.

The exemplary mounting arm shown herein is only intended to provide a simple example of how forward and backward adjustability, height adjustability, and angle adjustability can be provided to tailor the arm exercise device to a particular user or machine. Any type of adjustment mechanisms may be provided, including automatic or manual mechanisms.

Although shown only in a single embodiment mounted on the front of a treadmill, the single reel embodiment may be mounted on any lower body exercise device and may be mounted on the front or the rear of such device. Although shown with flared hand grips 1900, any type of user engagement may be used. Although shown without railings or an incline mechanism for simplicity, the single exercise reel design may be combined with adjustable railings or railings otherwise designed to avoid interference with the arm exercise, and the may be combined on a machine having an automated or manual incline mechanism.

Adjustable Elastic Resistance Devices

Elastic bands, cords, or tubing provide an alternative form of resistance that is inexpensive and generally effective. The term "elastic bands" is used herein to refer to any type of cord, band, tubing, or the like that has elasticity. There are three basic ways to provide adjustable resistance with elastic bands: change the length of the band that is elongated during exercise; change the number of bands elongated; and change the strength of the band.

FIG. 11 illustrates various embodiments 400 for providing adjustable resistance with elastic bands. Although several adjustment mechanisms are illustrated in a single example, it should be understood that a typical installation is mostly likely to have only one or two of these types of embodiments.

Changing the length can be accomplished any number of ways, including by putting a number of different attachment points 402*a-c* on the lower body exercise machine to which the band 404 can be attached, each attachment point a different distance from the user. Another method is to provide a buckle or other type of mechanism 406, known in the art, for changing the length between end 408 of the band closest to the user and the user engagement 1900. Another way is to provide a reel embodiment 410 on which elastic band 412 is wound on one end. In such an embodiment, the reel does not rotate during use, but rather serves as an anchor for the fixed end of the elastic member and an adjustment mechanism for the degree of resistance. The resistance can be adjusted by winding or unwinding the fixed portion of the elastic member onto or off of the reel, thereby changing the length of the free portion of the elastic member that stretched during use. The resistance of the cord to a swing of a given length is dependent upon the length of the free portion of the elastic member. Such a reel typically has mechanisms for winding and unwinding, and for fixing the reel at a certain rotated position, such as a ratchet mechanism.

Changing the number of bands can be accomplished by providing a plurality of bands 404 and 412 and attaching or detaching bands as additional resistance is desired. The bands that are combined may be of equal strength (not shown) or of a different strength. Typically the strength of an elastic band is determined by the cross-sectional area of the band (given bands of the same materials of construction). Thus, one mechanism for adjustment may be providing several bands, each of a different cross-sectional area, such as is illustrated in FIG. 11. The user can then completely switch one band for another to get the desired resistance. Or, as discussed above, and shown in FIG. 11, the user may combine bands of different sizes.

The bands are shown with a user engagement 1900 that promotes a loose, open grip and that allows use of the grip for forward or backward resistance, as described herein, but the user engagement is not limited to any particular style. The elastic bands may also be used to provide resistance to the foreswing, backswing, or both, of the user, as described herein. For example, different attachment points can be provided in front of and behind the user for attaching the elastic bands, or pulleys/guides can be provided to convert the bands from providing resistance from the direction where the anchor point is located, to providing resistance from the opposite direction where the pulley/guide is located.

It should be noted that although elastic bands are inexpensive, they have a non-linear resistance curve. In other words, as the bands are elongated, the amount of resistance to incremental elongation increases. By contrast, frictional resistance mechanisms such as those shown and described with respect to FIGS. 8 and 9, more nearly provide essentially the same amount of resistance across the entire length of the user's arm swing. That is, although the mechanisms shown in FIGS. 8 and 9 do have some amount of spring resistance (which may have a non-linear resistance curve), the major resistance component is the frictional component that is essentially linear. This is typically more desirable than having the entire resistance component subject to a variable resistance curve over the length of the swing, as is the case with elastic bands.

Exemplary User Engagements

Figure 6:
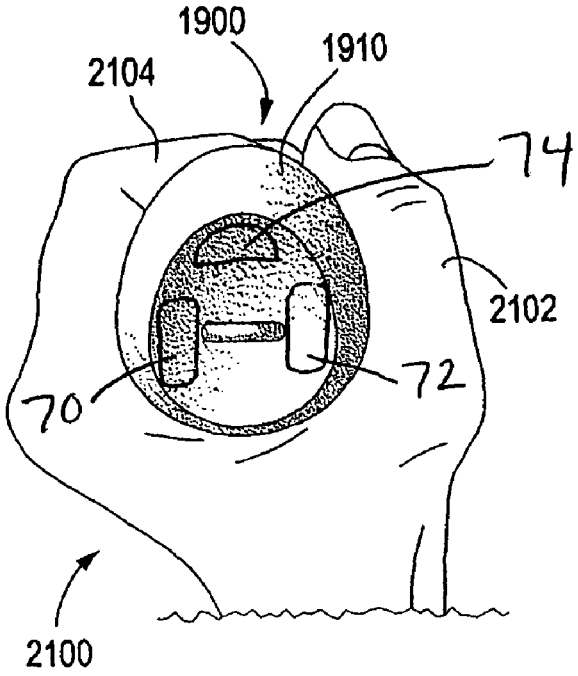
FIG. 6 shows a top view of an exemplary flared-top hand grip being held in a user's hand.
Figure 7:
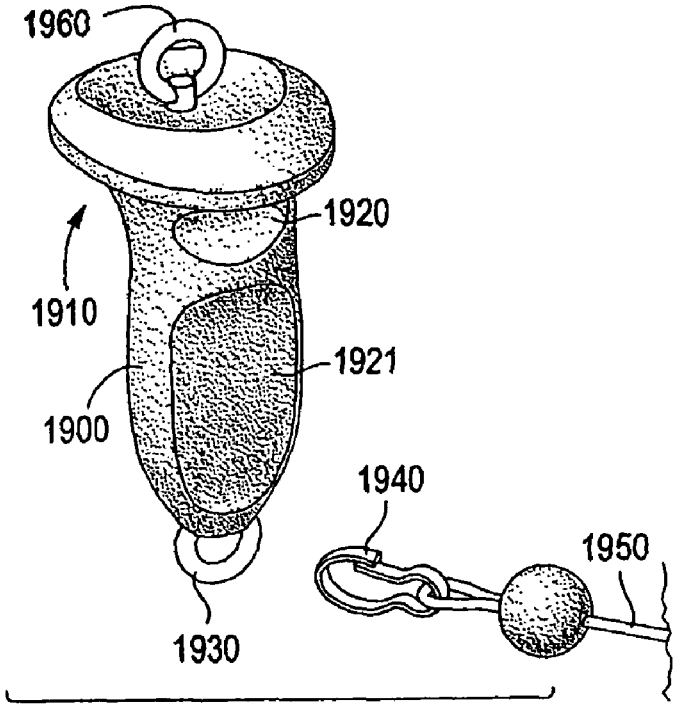
FIG. 7 is a perspective view illustration of an exemplary flared-top hand grip.

A desirable embodiment for the user engagement is shown in FIGS. 6 and 7. Hand grip 1900 comprises a flared top 1910 and a plurality of indents 1920 and 1921. Although shown with one indent 1920 for the user's thumb and one indent 1921 for the remaining fingers, any number of indents may be provided, including but not limited to, no indents, a single indent for the thumb and fingers together, or an indent for each of the thumb and fingers. Flared top 1910 distributes the pressure of the forward swing to the top of the hand 2100 to the thumb 2102 and fore-finger 2104, which stop the grip from slipping through the user's hand as shown in FIG. 21, and therefore allow the user to use a loose grip. Grip 1900 is also shown with an eyelet 1930 for engagement by, for example, a pinch-type clip 1940 at the end of elongated connector 1950. A detachable user engagement provides interchangeability of user engagements, which is a particularly desirable feature, because it allows the user to change the type of user engagement to accommodate the type of exercise. For example, a flared-top grip 1900 may be preferable for an aerobic exercise, whereas a more standard pull-type handle (not shown) may be more desirable for use for strength exercises, and a loop-type engagement may be more desirable for use with another part of the body, such as for leg exercises.

In another embodiment, the user engagement may be a comfortable, "hands-free" design that may be in the form of a padded, soft, non-chafing loop, as shown and described in the parent applications, or any other type of strap or grip that fits around the hand without requiring a closed grip by the hand. A material such as a dense foam rubber may provide the padded, soft, and non-chafing qualities desirable in any type of user engagement.

Figure 14A:
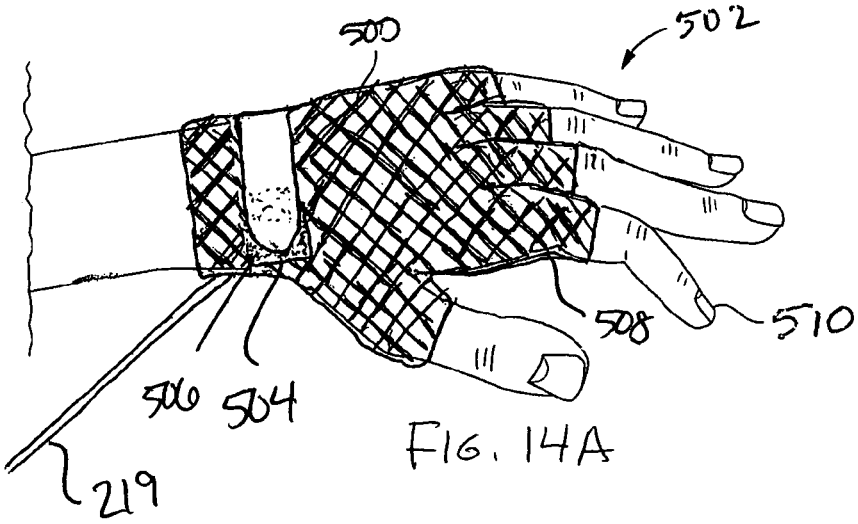
FIG. 14A is an illustration of an exemplary glove-type user engagement on a user's hand.
Figure 14B:
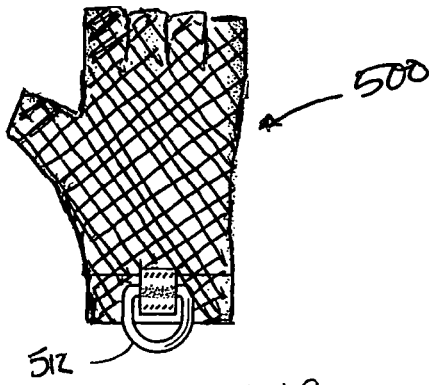
FIG. 14B is another view of the glove of FIG. 14B, showing the hasp for connection to the elongated connector.

In yet another embodiment, the "hands-free" design may comprise a glove, mitt, or other user engagement such as is shown and described in U.S. patent application Ser. No. 10/817,737, titled WEARABLE EXERCISE APPARATUS, filed Apr. 2, 2004, and in U.S. patent application Ser. No. 10/848,398, titled RESISTANCE EXERCISE GARMENT, both by the inventor of this application, and incorporated herein by reference. Glove 500 as shown in FIGS. 14A and 14B may be a particularly suitable embodiment. FIG. 14A illustrates exemplary glove 500 being worn on the hand 502 of a user. Glove 500 is preferably made of a breathable fabric, such as a netting of strong, yet comfortable members, and may have a tightening strap 504 in the back, such as with a VELCRO® microloop/microhook fastener. The thumb and fingers portions 508 of the glove preferably only partially cover the thumb and fingers 510 of the user, to minimize sweating. As is shown in the view in FIG. 14B, hasp 512, such as a traditional D-hasp known in the art is attached, preferably sewn, on the portion of the glove that is adjacent the palm or inside wrist of the user. The hasp is typically attached with heavy-duty stitching made to withstand the resistance force of the arm resistance device that is connected at the other end of elongated connector 219. The hasp may comprise any material known in the art, including but not limited to metal or a soft, strong synthetic material such as nylon. Although shown with netting, half-fingers, and a tightening strap, the glove may have less than all or none of these features, and thus the scope of the invention includes any type of glove user engagement having a hasp to which the elongated connector of a resistance device may be attached. Although ideal for use with the arm exercise devices and total body fitness combinations disclosed herein, the glove-type user engagement may be used with any type of exercise equipment, including articles of clothing having elastic bands connected thereto for providing exercise, such as are described in the applicant's earlier patents, including but not limited to, U.S. Pat. No. 5,186,701 and the aforementioned application Ser. No. 10/848,398.

The use of a padded, non-chafing loop, a gloves/mitt, or a flared-top grip for engaging the hand provides an open engagement by the hand that exerts less pressure on the hand or wrist than a closed grip. The open engagement also avoids the undesirably higher blood pressure that, according to some sources, may be promoted by a closed grip. An open engagement also does not tire or cramp the hand or fingers, nor does it rub or chafe the hand or fingers, making exercise over a longer time period possible. Significantly, a closed, tight grip tightens the muscles of the entire arm, thereby hindering a natural body motion, and the use of an open, loose, natural grip avoids this.

While the flared-top grip 1900, glove 500 or mitt, and a loop or cuff type grip all offer the advantages of an open engagement, the flared-top grip offers the additional advantage of allowing the user to more quickly disengage the user engagement, by dropping it, if necessary. A loop or glove/mitt may be somewhat more difficult to disengage quickly. The flared-top grip user engagement is particularly advantageous over the cuff-type user engagements, such as those shown, for example, in U.S. Pat. No. 6,123,649 to Lee et al., incorporated herein by reference, which may tend to snare or catch the hand or arm and in which a user may be more likely to be tangled upon stumbling or falling, creating a potential safety issue. The flared-top grip 1900 is preferably made of a padded, soft, non-chafing material, such as, for example, a dense foam rubber material.

The user engagement is not limited to any particular device, however, and may comprise any of the suitable mechanisms known in the art for enabling engagement by or attachment to a portion of the upper body, however, such as but not limited to handles, grips, bars, wraps, gloves, straps, cuffs, mitts, and the like. In other embodiments, the user engagement may be any device for engaging any part of the body, including the feet or legs, the waist, the torso, the head, the shoulders, and the like. The user engagement may be permanently attached to or detachable from connector 2004. Upper body user engagements may be designed to be attached to, engaged by, or held by any portion of the arms, wrists, hands, or fingers of the user. The user engagement may be securable to the arm or hands by any mechanism known in the art, such as but not limited to the user grasping or holding the means, or the means being secured to the user by any type of fastener such as one or more buckles, Velcro® fasteners, snaps, pressure fittings, hooks, loops, clips, and the like. User engagements for other parts of the body may be securable to the feet, legs, waist torso, head, shoulders, and the like. The user engagement is preferably padded for comfort, and/or lined for sweat absorption.

The connector on the upper body exercise module may fully retract up to stop 2040, providing compact storage. In other embodiments, holders may be provided in close proximity to the user, such as forward of the user, for resting the user engagements where they may be readily picked up and put down by the user. For example, as shown in FIG. 1, console 18 in front of user 14 may comprise wings 20 having upright posts 22 around which upper eyelets 1960 of flared-top grip 1900 may be optionally placed. For safety, posts 22 preferably have rounded, snubbed ends with a length just long enough to provide the required capability of docking the user engagement while not in use, without being cumbersome for retrieving the user engagement from the posts. So, a user wanting to discontinue the arm exercise portion of the workout for a period of time may merely continue exercising his legs while temporarily docking the user engagements on the machine where they can be readily picked up again without discontinuing the leg workout.

Although shown with posts 22, it should be recognized that any type of docking engagement mechanism may be used for temporarily storing the user engagement, including others described in the parent applications, and that for some lower body exercise machines other than treadmills, placement in close proximity to the user may be preferable in a location other than forward of the user, such as underneath the seat on an exercise bicycle. The invention is not limited to any particular type of docking arrangement.

Although specifically described with respect to a treadmill embodiment, any upper body exercise device embodiments discussed herein may be used for providing total body workouts for any type of exercise machines. Also, although shown mounted on the machines in exemplary embodiments herein, and described in more detail in the parent applications, the invention is not limited to any particular mounting arrangement for the upper body exercise devices. Furthermore, although referred to as an "upper body" exercise device, the device itself is not limited to use only for exercising the upper body.

Because of the backward resistance force applied by the arm-exercise mechanism in some embodiments, it may be desirable to include one or more attendant structures for counteracting forces transmitted by the resistance device that may tend to destabilize the user. Again, such structures are described in the parent application, and the present invention is not limited to any particular structures, or the presence or absence of such structures generally. Also, as noted in the parent applications, additional attributes may also be desirable for facilitating use of a resistance device mounted behind the user intended to provide resistance to a forward arm swing of a user on an exercise machine. Such attributes include side railings, where present, positioned either permanently to avoid interfering with the natural arm swing of universal user, or adjustable as described above to have at least one such position, and the console, control panel, or grab rail mounted in front of the user either permanently fixed far enough forward that they do not interfere with the natural arm swing, or adjustable so as to allow a full natural arm swing.

The resistance provided by the upper body exercise device is preferably unidirectional, preferably provided on the forward arm swing. The unidirectional resistance allows for two phases of exercise: an exertion phase (on the foreswing for rear-mounted devices) and a resting phase (on the backswing for rear-mounted devices). The upper body exercise device may also be used to provide resistance for backward arm motion, or multiple units may be used to provide bi-directional resistance both on the forward and backward swing, as shown and explained in the parent applications.

As noted above and in the parent applications, any type of resistance mechanism may be used to provide the upper body exercise module for use with the present invention. The use of elastic members for enhancing a workout is taught generally in U.S. Pat. Nos. 5,405,305, 5,476,431, and 5,632,708, incorporated herein by reference. As used herein the term "elastic member" refers to any type of exercise bands, tubing, ropes, or cords known in the art that provide resistance to being stretched, and include any type of materials of construction, including natural and synthetic materials. Elastic members can also be made to have an adjustable resistance force, and a number of adjustable mechanisms are described in the parent application. Additional mechanisms are discussed below.

Location Of The Resistance Device

As noted in the parent applications, the anchor point or points for the upper body exercise device may be located anywhere, but are preferably located on or connected to the exercise machine itself, or on a platform for mounting under the exercise machine. The anchor point may be located on the base or lower frame of the exercise machine, and, for providing resistance to the user's natural foreswing, preferably to the rear of the user at a height within a range between and including the user's feet to the user's hips. In other embodiments, the anchor point for the resistance device may actually be located somewhere other than behind the user, with guides used for bringing the cables to the rear of the user. Similarly, for providing backswing resistance, the anchor point may be located in front of the user, or elsewhere with guides mounted in front of the user. The upper body exercise devices may be detachable or permanently or semi-permanently anchored. The attachment mechanism at the anchor point may be a quick-connect mechanism that allows for the upper body exercise devices to be quickly replaced or moved easily from place to place around the machine, from machine to machine, or from machine to non-machine or free-standing locations. The attachment mechanism may be adapted for easy detachment by the user, or may be intended to remain fixed without routine detachment by the user. The invention is not limited to any particular type of attachment mechanism.

Rather than being mounted directly on the exercise machine or mounted to a platform that is held in place by the weight of the lower body exercise machine resting on the platform, the upper body exercise devices of the present invention may instead be mounted to another structure that is not connected to the lower body exercise machine. Exemplary structures may include the wall, ceiling, or floor of the room in which the lower body exercise machine is located, or a free-standing structure (not shown) having sufficient mass to be stable when encountering the forces generated by the user pulling on the elongated connecting member.

Although described above with respect to self-contained resistance mechanisms mounted to the lower body exercise machine behind the user, the resistance mechanism may be mounted elsewhere on the machine (or elsewhere relative to the machine) and directed to a point behind the user with rollers, pulleys or guides. Although rear mounting of the resistance modules is preferred for providing resistance to a full, natural forward arm swing of a user, it may still be desirable to offer the user the option of alternatively providing resistance to the backswing. One simple way of providing this functionality, is to provide a pulley or guide 1875 at the front of the exercise machine, such as on console 18 as depicted in FIG. 1, around which the cable 2004 can be wrapped to provide resistance from in front of the user. An alternative arrangement, is to provide mounting posts 1880 at the front of the machine to which the resistance devices 1800 can be mounted and held in place by inserting pins 1810 through holes 1882.

The use of mounting posts allows a user to optionally place reels at both the front and the back of the exercise machine to provide resistance to both the foreswing and the backswing, using the upper and lower rings 1930 and 1960 of a single grip 1900 as a point to which the cables from each reel can be fastened, such as by using a clip 1940 as shown in FIG. 7. Thus user engagement 1900 is unique in that it is flared-top hand grip that is reversible for use in providing a loose, open grip for both forward and backward arm swing exercises. For an embodiment in which resistance is provided to both the forward and backward swing simultaneously, the grip may be flared at both ends in the manner shown for a single end in FIG. 6. Mounting posts with pins and holes may also have a plurality of holes that allow a user to affix the upper body resistance modules to the machine with its direction reversed, so that the user engagement faces away from the lower body exercise machine, thereby allowing the user to use the devices for other exercises while not standing on the machine. This allows the resistance modules to be used for performing exercises other than just a forward or backward arm swing and for exercising other parts of the body without any limitations caused by the lower body exercise machine.

Where a forward pulley or guide is used to enable a user to covert a rear-mounted resistance device to provide resistance to the user's arm backswing, it is important that the length of the cable and the carrying capacity of the spool is sized appropriately to provide enough cable to reach from the mounting point of the reel to the pulley and through a fully backswing of any sized user standing in any operating position on the machine. It may be desirable to provide the pulley or guide with a deep groove or channel to ensure that the cable stays engaged with the pulley or guide despite a non-zero angle between the portion of the cable entering the pulley/guide from the resistance device and the portion of the cable exiting the pulley/guide to the user. It may also be desired to provide a pulley that can swivel or rotate to provide an optimal orientation to accommodate such a non-zero angle.

Reel 1800 as shown in FIGS. 8 and 9 has a manual resistance adjustment effected by turning knob 2019. It should be understood that the resistance adjustment may also be automated, such as with a motor which turns shaft 2018. Similarly, the treadmill incline adjustment is preferably automated. Automated adjustment features enables adjustment of the resistance or the treadmill incline "on-the-fly", such as with a remote control integrated into the user engagement, or provided on the exercise machine, such as on a panel in front of or beside the user. For example, as shown in FIG. 3, the console comprises three sets of buttons 40, 50, and 60. For example, set 40 may increase or decrease resistance of the left upper body exercise module, set 60 may increase or decrease resistance of the right upper body exercise module, and set 50 increase or decrease the incline of the treadmill. Thus, the user may increase or decrease the resistance without stopping the exercise. Although shown with push buttons, the remote control may comprise a knob, a joystick, a touch screen, or any type of control interface known in the art. For knob control, turning the knob one direction may increase resistance whereas turning the knob the other direction may decrease resistance. In push button embodiments, dual or single push button control may be provided.

In another embodiment, the remote control, such as push button, may be integrated into the user engagement, such as hand grip 1900, as shown in FIG. 6. In a single button mode, the adjustment may continuously run through a loop of increasing and decreasing resistance when the button is depressed, such that the user need merely hold the button down until the desired resistance is achieved. In a dual button mode, such as is shown in FIG. 6, one button 70 may increase resistance and the other button 72 may decrease resistance, or vice versa. Similarly, a button 74 on the left user engagement may decrease the treadmill bed incline, and a similar button (not shown) on the right user engagement may increase the treadmill bed incline (or vice versa). In other embodiments, both the buttons for increasing and decreasing the incline may be mounted on a single (or both) user engagement(s), or the resistance control may be on the user engagement and the incline control may be on the console, or vice versa. It should be understood that some embodiments may only have automated resistance control, whereas others have only automated incline control, still others may have both, and yet others may have neither. The invention is not limited to any particular combination of features. Mechanical, as opposed to electrical, on-the-fly adjustment mechanisms may also be provided. The adjustment mechanisms may be wireless or wired connections.

One preferred embodiment of the invention comprises a manual treadmill having an automated incline mechanism, adjustable upper-body resistance devices—one for each arm—adapted to provide resistance to a full, natural arm swing of the user, and a set of adjustable railings having a close position relatively close to the user and a far position sufficiently removed from the user to avoid collision with the natural arm swing of the user. The treadmill preferably has means for providing the resistance at least from the rear of the user, and optionally from the front of the user, and the user engagement promotes an open, loose grip, and is detachable from the connector for use with either a forward swing or a backward swing. The treadmill also preferably has means for resting the user engagements forward of the user when not in use. Also preferably, the upper body exercise devices are reversible on their mountings to the treadmill frame such that they can be used for other exercises by a user not standing on the treadmill.

Although a preferred embodiment is described herein in which the adjustable railings and adjustable incline are combined with upper body exercise devices on a lower body exercise machine, it should be understood other lower body exercise machine embodiments of the present invention may only include one of the adjustable incline or the adjustable railings in combination with the upper body exercise devices.

Although various embodiments of the invention have been described, it will be understood that the invention is not limited to these embodiments, but is capable of numerous modifications of parts, elements and materials without departing from the invention.

What is claimed:

1. An exercise apparatus for exercising the upper body simultaneously with lower body exercise, the apparatus comprising:

a lower body exercise machine, the lower body exercise machine having a lower body exercise resistance mechanism for providing resistance to lower body exercise;

at least one upper body exercise module mounted on the lower body exercise machine, or to one or more mounting assemblies affixed to the lower body exercise machine, in a position that does not interfere with an otherwise existing egress path directly behind a user as defined by a predetermined, normal, forward-facing user position on the lower body exercise machine, the at least one upper body exercise module adapted to provide resistance to a full natural arm swing of at least one arm of the user, the at least one upper body exercise module comprising:

an elongated connector having first and second ends;

a user engagement connected to the elongated connector first end for engaging or being engaged by a body appendage of a user; and an upper body exercise resistance mechanism for resisting a tensile force applied to the first end of the elongated connector, wherein the upper body exercise resistance mechanism is independent of the lower body exercise resistance mechanism and does not exclusively consist of elasticity of the elongated connector.

2. The apparatus of claim 1, further comprising at least one railing attached to the lower body exercise machine positioned to prevent interference with the full natural arm swing of the user during use of the upper body exercise module simultaneously with the lower body exercise machine.

3. The apparatus of claim 2, wherein the at least one railing comprises an adjustable railing having at least a close position suitable for gripping by the user while using the lower body exercise machine without simultaneously using the upper body exercise module, and a far position sufficiently distant from the close position to prevent interference with the full natural arm swing of the user during use of the upper body exercise device simultaneously with the lower body exercise machine.

4. The apparatus of claim 1, wherein the lower body exercise machine comprises a treadmill.

5. The apparatus of claim 4, wherein the treadmill comprises a non-motorized treadmill.

6. The apparatus of claim 4, wherein the treadmill comprises a motorized treadmill.

7. The apparatus of claim 3, wherein the lower body exercise machine comprises a treadmill and the railing has a first position substantially parallel to a bed of the treadmill and a second position angled relative to the treadmill bed.

8. The apparatus of claim 1, wherein the user engagement is adapted to be engaged by the user with a loose, open grip.

9. The apparatus of claim 1, wherein the at least one upper body resistance module has an adjustable resistance.

10. The apparatus of claim 1, wherein the lower body exercise machine comprises a user platform positioned relative to a surface on which the lower exercise machine is positioned, further comprising a mechanism for adjusting an incline of the platform relative to the surface.

11. The apparatus of claim 10, wherein the mechanism for adjusting the incline is automated.

12. The apparatus of claim 11, wherein the lower body exercise machine comprises a non-motorized treadmill.

13. The apparatus of claim 10, wherein the mechanism for adjusting the incline is non-automated.

14. The apparatus of claim 10, wherein the at least one upper body resistance module has an adjustable resistance and at least one of the mechanism for adjusting the incline or the mechanism for adjusting the resistance is automated.

15. The apparatus of claim 14, wherein the automated adjustment mechanism comprises a control for the mechanism located on a console of the lower body exercise device.

16. The apparatus of claim 14, wherein the automated adjustment mechanism comprises a control for the mechanism located on the user engagement for the upper body exercise module.

17. The apparatus of claim 1, wherein the at least one upper body exercise module is positioned to provide resistance to a forward arm swing of the user.

18. The apparatus of claim 1, wherein the upper body resistance module is positioned to provide resistance to a backward arm swing of the user.

19. The apparatus of claim 1, wherein the lower body exercise machine comprises means for positioning the upper body resistance module to provide resistance to a forward arm swing of the user or to a backward arm swing of the user.

20. The apparatus of claim 19, wherein the user engagement comprises a flared-top hand grip that is reversible for use with resistance to a forward arm swing or a backward arm swing.

21. The apparatus of claim 1, wherein the upper body resistance module is adapted to be positioned for use by a user located other than on the lower body exercise machine, for performing exercises for one of the upper body, the lower body, or both, using the resistance module.

22. The apparatus of claim 1, further comprising a docking interface for resting the user engagement forward of the user when the upper body resistance module is not in use.

23. The exercise device of claim 3, wherein the adjustable railing is manually adjustable.

24. The exercise device of claim 3, wherein the adjustable railing is automatically adjustable.

25. The exercise device of claim 10, wherein the mechanism for adjusting the incline is operable by the user from a normal use position on the lower body exercise machine.

26. The exercise device of claim 1, wherein the lower body exercise device is selected from a group consisting of: treadmills, air walkers/gliders, upright and recumbent bicycle machines, torso-twisting disks, cross-trainers, steppers, elliptical exercise machines, cross-country and downhill ski machines, trampolines, squat machines, rowing machines, stretching machines, and riders.

27. The apparatus of claim 1 further comprising an adjustable railing attached to the lower body exercise machine having at least a first position suitable for gripping by the user while using the lower body exercise machine, and a second position sufficiently distant from the first position to prevent interference with the full natural arm swing of the user during use of the upper body exercise device simultaneously with the lower body exercise machine.

28. The exercise device of claim 27, wherein the lower body exercise device comprises an upright or recumbent bicycle machine and the adjustable railing comprises a handlebar.

29. The exercise device of claim 27, wherein the adjustable railing is manually adjustable.

30. The exercise device of claim 27, wherein the adjustable railing is automatically adjustable.

31. The exercise device of claim 27 wherein the adjustment mechanism provides an inward/outward pivot, a forward/backward adjustment, an up/down adjustment, or a combination thereof.

32. The apparatus of claim 1, wherein the upper body resistance mechanism comprises a friction brake mechanism.

33. The apparatus of claim 27, wherein the upper body mechanism comprises a friction brake mechanism.

34. The apparatus of claim 1, wherein a portion of the upper body resistance is provided by elasticity of the elongated connector.

35. An exercise apparatus for exercising the upper body simultaneously with lower body exercise, the apparatus comprising:

a lower body exercise machine;

at least one upper body exercise module affixed to the lower body exercise machine or to one or more mounting assemblies affixed to the lower body exercise machine, the at least one upper body exercise module positioned (a) to provide resistance to a full natural forward arm swing of at least one arm of a user and (b) not to interfere with an otherwise existing egress path directly behind the user as defined by a predetermined, normal forward-facing user position on the lower body exercise machine, the at least one upper body exercise module comprising:

an elongated connector having first and second ends;

a user engagement connected to the elongated connector first end for engaging or being engaged by a body appendage of a user; and an upper body resistance mechanism for resisting a tensile force applied to the first end of the elongated connector, wherein the upper body resistance mechanism does not exclusively consist of elasticity of the elongated connector.

36. An exercise apparatus for exercising the upper body simultaneously with lower body exercise, the apparatus comprising:

a manual treadmill comprising a user platform positioned relative to a surface on which the treadmill is positioned, the treadmill comprising a leg exercise resistance mechanism for providing resistance to user leg movement and an incline-adjusting mechanism for automatically adjusting an incline of the platform relative to the surface, and;

at least one upper body exercise module positioned for engagement by a user of the treadmill, each upper body exercise module adapted to provide resistance to a full natural arm swing of at least one arm of the user, each upper body exercise module comprising:

an elongated connector having first and second ends;

a user engagement connected to the elongated connector first end for engaging or being engaged by a body appendage of a user; and an upper body exercise resistance mechanism for resisting a tensile force applied to the first end of the elongated connector, wherein the upper body exercise resistance mechanism is independent from the leg exercise resistance mechanism.

37. The apparatus of claim 36, comprising a first upper body exercise module for one arm and a second upper body exercise module for the other arm.

38. The apparatus of claim 36, wherein the treadmill comprises means for positioning the upper body resistance modules to provide resistance to a forward arm swing of the user or a backward arm swing of the user.

39. The apparatus of claim 36, wherein the upper body resistance module has at least two mounting positions relative to the lower body exercise machine: a first position for use by a user on the lower body exercise machine, and a second position for use by a user not on the lower body exercise machine.

40. The apparatus of claim 36, further comprising docking interfaces for resting the user engagements in close proximity to the user when the upper body resistance modules are not in use.

41. The apparatus of claim 36, further comprising at least one railing along at least one side of the treadmill positioned to prevent interference with the full natural arm swing of the user during use of the upper body exercise device simultaneously with use of the treadmill.

42. The apparatus of claim 36, wherein the at least one railing comprises an adjustable railing having at least a close position suitable for gripping by the user while using the treadmill without simultaneously using the upper body exercise device, and a far position sufficiently distant from the close position to prevent interference with the full natural arm swing of the user during use of the upper body exercise device simultaneously with the treadmill.

43. The apparatus of claim 36, wherein the upper body resistance mechanism comprises elastic bands.

44. The apparatus of claim 43, wherein the resistance is adjustable and the adjustability is provided by one or more of: (a) providing multiple locations for connection of one end of each elastic band to the machine, (b) providing multiple attachable and detachable bands of equal or different strength; and (c) providing a mechanism for changing the operable length of the stretchable portion of the elastic band.

45. An exercise apparatus for exercising the upper body simultaneously with lower body exercise, the apparatus comprising:

a lower body exercise machine other than a cross-country ski machine or a treadmill, the lower body exercise machine having a lower body resistance mechanism for providing resistance to lower body exercise;

a single upper body exercise module mounted on the lower body exercise machine in a forward position to provide resistance to a backward arm swing of each arm of the user, the upper body exercise module comprising a pair of user engagements attached to an elongated connector wound at least partially around a reel, the reel comprising means for resisting revolution of the reel in response to a pulling force transmitted by the user onto the elongated connector, wherein the reel is independent from the lower body resistance mechanism.

46. The exercise apparatus of claim 45, further comprising mounting apparatus for attaching the upper body exercise module to the lower body exercise machine, wherein the mounting apparatus is adapted to allow a user to adjust a length of the module from the lower body exercise machine, an angle of the mounting apparatus relative to the machine, an angle of the module relative to the mounting apparatus, or a combination thereof.

47. The exercise apparatus of claim 45, further comprising a user engagement adapted to provide a loose, open grip.

48. The apparatus of claim 45, wherein the upper body resistance module has at least two mounting positions relative to the lower body exercise machine: a first position for use by a user on the lower body exercise machine, and a second position for use by a user not on the lower body exercise machine.

49. An exercise apparatus for exercising the upper body simultaneously with lower body exercise, the apparatus comprising:

a lower body exercise machine other than a cross-country ski machine;

a single upper body exercise module attached in a forward position on the lower body exercise machine to provide resistance to a backward arm swing of each arm of the user, the upper body exercise module comprising a pair of user engagements attached to an elongated connector wound at least partially around a reel, the reel comprising means for resisting revolution of the reel in response to a pulling force transmitted by the user onto the elongated connector; and at least one adjustable railing attached to the lower body exercise machine, the at least one railing having at least a close position suitable for gripping by the user while using the lower body exercise machine without simultaneously using the upper body exercise device, and a far position sufficiently distant from the close position to prevent interference with the full natural arm swing of the user during use of the upper body exercise device simultaneously with the lower body exercise machine.

50. The apparatus of claim 45, wherein the lower body exercise machine comprises a user platform positioned relative to a surface on which the lower exercise machine is positioned, the lower body exercise machine comprising a mechanism for adjusting an incline of the platform relative to the surface.

* * * * *